US006843554B2

(12) United States Patent
Nagata et al.

(10) Patent No.: US 6,843,554 B2
(45) Date of Patent: Jan. 18, 2005

(54) INK JET HEAD AND METHOD OF PRODUCTION THEREOF

(75) Inventors: Jun Nagata, Hitachinaka (JP); Tomohiko Koda, Hitachinaka (JP); Yasuhiro Yoshimura, Tsuchiura (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 62 days.

(21) Appl. No.: 10/418,289

(22) Filed: Apr. 18, 2003

(65) Prior Publication Data

US 2003/0222945 A1 Dec. 4, 2003

(30) Foreign Application Priority Data

Apr. 18, 2002 (JP) ..... P2002-116232

(51) Int. Cl.[7] ..... B41J 2/045; B41J 2/04

(52) U.S. Cl. ..... 347/68; 347/70; 347/54

(58) Field of Search ..... 347/54, 68, 70; 29/25.35, 890.09

(56) References Cited

U.S. PATENT DOCUMENTS

| | | | | |
|---|---|---|---|---|
| 4,751,774 A | | 6/1988 | DeYoung et al. | |
| 5,381,171 A | * | 1/1995 | Hosono et al. | 347/72 |
| 5,610,643 A | * | 3/1997 | Kutami et al. | 347/54 |
| 5,710,584 A | | 1/1998 | Suzuki et al. | |
| 6,109,728 A | * | 8/2000 | Kakuda et al. | 347/45 |
| 6,328,421 B1 | * | 12/2001 | Kojima et al. | 347/46 |
| 6,361,152 B1 | | 3/2002 | Fujisawa | |
| 6,398,350 B2 | * | 6/2002 | Kitahara | 347/70 |

FOREIGN PATENT DOCUMENTS

| | | |
|---|---|---|
| DE | 199 31 110 A 1 | 7/1999 |
| JP | 3070625 | 5/2000 |
| JP | 2000280470 | 10/2000 |

* cited by examiner

*Primary Examiner*—Anh T. N. Vo
(74) *Attorney, Agent, or Firm*—Whitham, Curtis & Christofferson, P.C.

(57) ABSTRACT

An ink jet head including nozzles, ink chambers, and an ink channel in fluid communication with each other. A diaphragm defines one portion of each of the ink chambers. Piezoelectric actuators are disposed in confrontation with the diaphragm in a one-to-one correspondence with the ink chambers. A relay member is provided between each piezoelectric actuator and the diaphragm. Each relay member has a first abutment surface and a second abutment surface on opposite sides thereof. Each first abutment surface abuts the diaphragm across a width that extends in the nozzle alignment direction. The width of each first abutment surface is shorter than the width of the corresponding ink chamber. Each second abutment surface is coupled to the corresponding piezoelectric actuator and has a width that extends in the nozzle alignment direction. The width of each second abutment surface is equal to or shorter than the width of the corresponding piezoelectric actuator. The width of each first abutment surface is shorter than the width of each second abutment surface.

36 Claims, 27 Drawing Sheets

406
401
405
404
403
402
423
20 μm
50 μm
426a
426b
407
412
413
411
410
30 μm
10 μm
426c
426

INK JET HEAD AND METHOD OF PRODUCTION THEREOF

BACKGROUND OF THE INVENTION

1. Field of the Invention

The present invention relates to an ink jet head and a method of producing the ink jet head.

2. Description of Related Art

Japanese patent publication No. 3,070,625 discloses an ink jet printer that includes piezoelectric actuators, a diaphragm, and a plurality of ink chambers. The piezoelectric actuators are mechanically connected to the diaphragm at positions that correspond to the ink chambers. The piezoelectric actuators serve as a drive source by extending or contracting to produce a displacement at positions corresponding to the ink chambers. The displacement generates a pressure fluctuation in the corresponding pressure chamber to eject ink from the nozzle connected to the pressure chamber.

Elongated islands are deposited on the diaphragm. Each island is positioned in between one of the piezoelectric actuators and the corresponding ink chamber. The islands are for ensuring that the piezoelectric actuators apply pressure to the diaphragm across a uniform surface area. Because the pressed surface area is the same for all ink chambers, the resolution of printed images is quite high. Also, the islands enable providing a great number of nozzles (ink chambers and piezoelectric actuators) in a small area.

The diaphragm is produced using nickel electroforming. However, nickel is relatively reactive material and so can corrode in ink. To prevent the nickel from corroding, recently a diaphragm with a two-layer structure of resin and metal has been considered. A thin metal plate is laminated onto polyethylene terephthalate, polyimide, or other resin with good chemical resistance. The metal plate is then etched to form islands at positions corresponding to where the ink chambers will be located. The side made from the resin layer confronts the ink chambers and the side with the nickel islands faces away from the ink chambers. In this way, only the resin layer is brought into contact with the ink and the nickel islands are isolated from the ink by the resin layer. Therefore, the nickel islands are not corroded.

However, resin has a large thermal expansion coefficient. The islands can be shifted out of the center of the ink chambers if the resin layer of the diaphragm expands when the diaphragm is adhered to the ink chamber structure. This is especially a problem when the ink chamber structure is made from a material with low thermal expansion. Silicon is one such low thermal expansion material that has been drawing attention because it can be etched with high precision of +/−2 microns. A complicated adhesion process must be performed to insure that the islands are located at the center of the ink chambers.

To reduce the complication of the adhesion process, it is conceivable to use an adhesive that cures at a low temperature to adhere the diaphragm to the ink chamber member. However, adhesives that cure at low temperatures of about 60° C. take a long time to harden. Efficiency of the ink jet head production process would suffer. Also, limits are placed to the types of adhesive that can be used. This also places restrictions on the ambient temperature that the ink jet printer can be used in and the types of ink that can be used in the ink jet printer.

Using the method of etching to form the islands can be problematic in a head with a highly dense nozzle arrangement of 75 dpi (dots per inch) or greater. For example, it is difficult to form the islands with proper dimensional precision because the islands have such a narrow width. Also, the islands can be unintentionally removed while forming the islands using etching. This can reduce production yield.

These problems of poor dimensional precision and removing the islands can be resolved by forming the metal islands with only a thin thickness above the surface of the resin layer. If the nickel layer is formed thin in the first place, then the etching time can also be reduced. However, when the islands are formed too thin, they do not properly perform their function because they can follow the vibration of the diaphragm plate.

U.S. Pat. No. 4,751,774 discloses adhering a molded protrusion onto the tip of each piezoelectric actuator. However, if the ink jet head has a highly dense nozzle arrangement of 75 dpi or more, then it can be quite difficult to adhere the molded protrusion members onto the tips of the piezoelectric actuators. Further, it is virtually impossible to position the protrusion members precisely at the locations of the ink chambers.

SUMMARY OF THE INVENTION

In the view of the foregoing, it is an objective of the present invention to overcome the above-described problems and to provide an ink jet head, a method of producing the ink jet head, and a highly integrated ink jet printer including the ink jet head, wherein pressure is applied to the diaphragm at the same position of each ink chamber and across a consistent surface area, so that the ink jet head that can be used in a variety of ways and can achieve high-quality printing.

In order to attain the above and other objects, the present invention provides an ink jet head. The ink jet head includes a channel member formed with a plurality of nozzles, a plurality of ink chambers, and an ink channel, the nozzles being aligned in a nozzle alignment direction, the ink chambers each having a width extending in the nozzle alignment direction, the nozzles and the ink chambers being provided in a one-to-one correspondence, each ink chamber being in fluid communication with a corresponding one of the nozzles and the ink channel, the ink channel supplying ink to fill the ink chambers, a diaphragm defining one portion of each of the ink chambers, a plurality of piezoelectric actuators in confrontation with the diaphragm in a one-to-one correspondence with the ink chambers, a drive unit that deforms the piezoelectric actuator to deform the diaphragm and change the pressure inside the ink chamber to eject ink from the ink chamber through the nozzle, and a plurality of relay members in a one-to-one correspondence with the ink chambers and the piezoelectric actuators, each relay member having a first abutment surface and a second abutment surface on opposite sides thereof, each first abutment surface abutting the diaphragm across a width that extends in the nozzle alignment direction, the width of each first abutment surface being shorter than the width of the corresponding ink chamber, each second abutment surface being coupled to the corresponding piezoelectric actuator and having a width that extends in the nozzle alignment direction, the width of each second abutment surface being equal to or shorter than the width of the corresponding piezoelectric actuator, the width of each first abutment surface being shorter than the width of each second abutment surface.

The present invention also provides a method of producing an ink jet head. The method of producing an ink jet head includes a channel member formed with ink chambers, a diaphragm forming at least a portion of each ink chamber, and a plurality of piezoelectric actuators each generating displacement, the method including preparing a relay plate having a relay member group including a plurality of relay members and connection portions, the connection portions being disposed between and connecting adjacent relay members, and a positioning portion for positioning the relay members into alignment with the ink chambers, adhering the relay member group onto a piezoelectric block, cutting the relay plate and the piezoelectric block to produce piezoelectric actuators and relay members in a one-to-one correspondence with the ink chambers, each relay member having one end attached to a corresponding one of the piezoelectric actuators and another end being free, after the process of cutting, aligning the relay members with the ink chambers using the positioning portion, and adhering the free ends of the relay members onto the diaphragm at positions corresponding to the ink chambers.

The present invention also provides a method for producing an ink jet head. The method for producing an ink jet head includes a channel member formed with ink chambers, a diaphragm forming at least a portion of each ink chamber, and a plurality of piezoelectric actuators each generating displacement, the method including fixing a piezoelectric block onto a support member, preparing a relay plate including, a plurality of relay members aligned in an alignment direction, a positioning portion for positioning the relay members into alignment with the ink chambers, and a connection portion that connects the plurality of relay members to the positioning portion, adhering the relay plate to the piezoelectric block, cutting the connection portion in a direction parallel to the alignment direction of the relay members to divide the relay plate into the positioning portion and the relay members, dividing the piezoelectric block in a one-to-one correspondence with the ink chambers to form the piezoelectric actuators to produce a drive portion, preparing a channel member including the ink chambers, and coupling the drive portion to the channel member.

The present invention also provides a method of producing an ink jet head. The method includes preparing a support member including with two positioning holes, fixing a piezoelectric block onto the support member, preparing a relay plate including, a plurality of relay members aligned in an alignment direction, a positioning portion for positioning the relay member group with respect to the ink chambers, the positing portion including two positioning holes at positions corresponding to the positioning holes of the support member, and a connection portion that connects the plurality of relay members to the positioning portion, preparing two positioning members, inserting the two positioning members into the two positioning holes of the support members and into the two positioning holes of the positioning portion to position the relay plate with respect to the support member, fixing the relay plate onto the piezoelectric block, cutting the relay plate and the piezoelectric block into a one-to-one correspondence with the ink chambers, cutting away the positioning portion to produce a drive portion, preparing a channel member with the ink chambers, and coupling the drive portion onto the channel member.

BRIEF DESCRIPTION OF THE DRAWINGS

The above and other objects, features and advantages of the invention will become more apparent from reading the following description of the preferred embodiments taken in connection with the accompanying drawings in which:

FIG. 5(*b*) is a perspective view showing a step of adhering a piezoelectric block to the support block according to a production method of the ink jet head of the first embodiment;

FIG. 18(*b*) is a cross-sectional view showing a second step in producing the relay plate according to the first production method;

FIG. 18(*c*) is a cross-sectional view showing a third step in producing the relay plate according to the first production method;

FIG. 18(*d*) is a cross-sectional view showing a fourth step in producing the relay plate according to the first production method;

FIG. 18(*e*) is a cross-sectional view showing a fifth step in producing the relay plate according to the first production method;

FIG. 18(*f*) is a cross-sectional view showing a sixth step in producing the relay plate according to the first production method;

FIG. 18(*g*) is a cross-sectional view showing a seventh step in producing the relay plate according to the first production method;

FIG. 18(*h*) is a cross-sectional view showing an eighth step in producing the relay plate according to the first production method;

FIG. 18(*i*) is a cross-sectional view showing a ninth step in producing the relay plate according to the first production method;

FIG. 18(*j*) is a cross-sectional view showing a tenth step in producing the relay plate according to the first production method;

FIG. 19(*b*) is a cross-sectional view showing a second step in producing the relay plate according to the second production method;

FIG. 19(*c*) is a cross-sectional view showing a third step in producing the relay plate according to the second production method;

FIG. 19(*d*) is a cross-sectional view showing a fourth step in producing the relay plate according to the second production method;

FIG. 20(*b*) is a cross-sectional view showing a second step in producing the relay plate according to the third production method;

FIG. 20(*c*) is a cross-sectional view showing a third step in producing the relay plate according to the third production method;

FIG. 20(*d*) is a cross-sectional view showing a fourth step in producing the relay plate according to the third production method;

FIG. 21(*b*) is a cross-sectional view showing a second step in producing the relay plate according to the fourth production method;

FIG. 21(*c*) is a cross-sectional view showing a third step in producing the relay plate according to the fourth production method;

FIG. 22(*b*) is a cross-sectional view showing a second step in producing the relay plate according to the fifth production method;

FIG. 22(*c*) is a cross-sectional view showing a third step in producing the relay plate according to the fifth production method;

FIG. 22(*d*) is a cross-sectional view showing a fourth step in producing the relay plate according to the fifth production method;

FIG. 33(*b*) is a cross-sectional view taken along line XXXIII(b)—XXXIII(b) of FIG. 33(*a*);

DETAILED DESCRIPTION OF THE PREFERRED EMBODIMENTS

Next, an ink jet head 22 shown in FIG. 1 will be described according to a first embodiment of the present invention.

Figure 2:
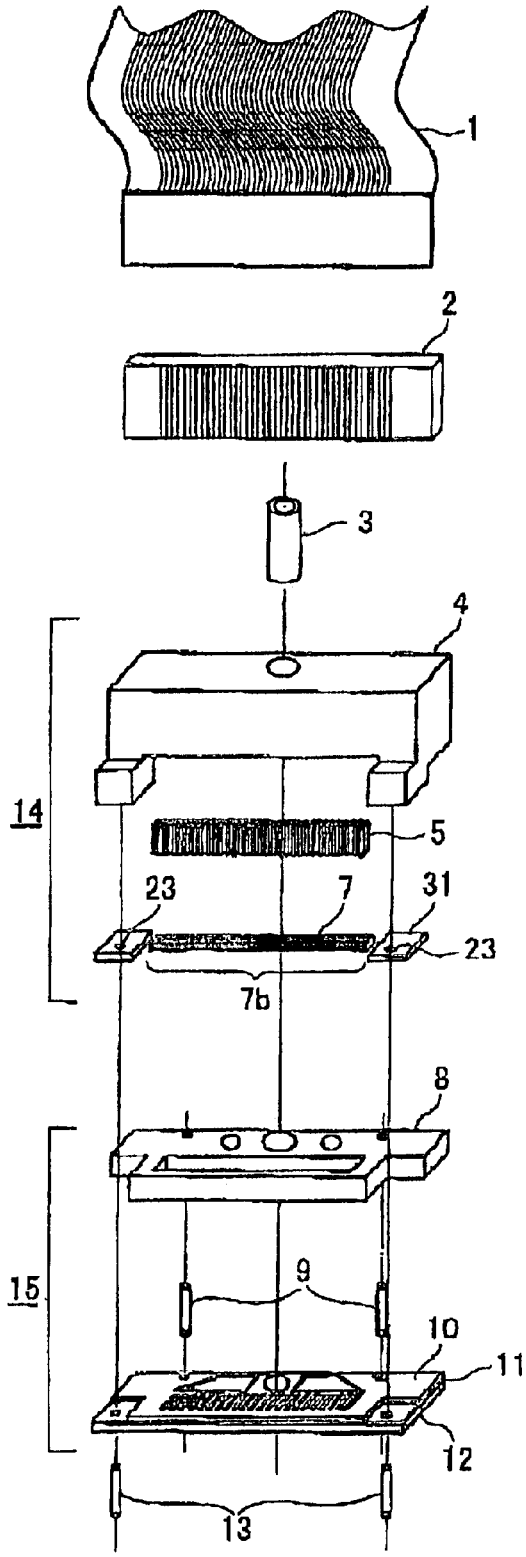
FIG. 2 is an exploded view showing the ink jet head of FIG. 1.
Figure 3:
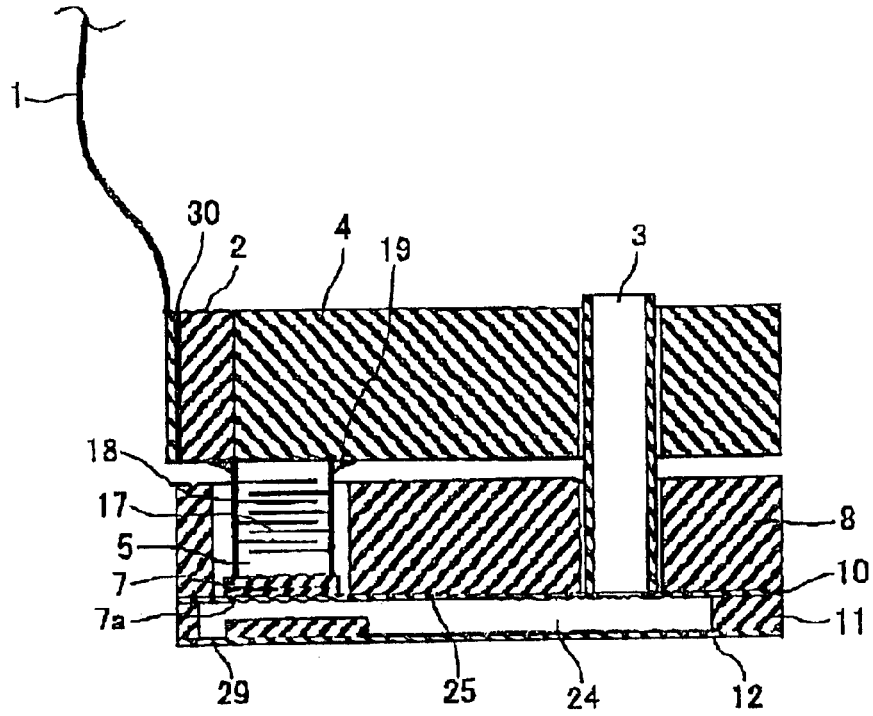
FIG. 3 is a side cross-sectional view showing the ink jet head of FIG. 1.
Figure 4:
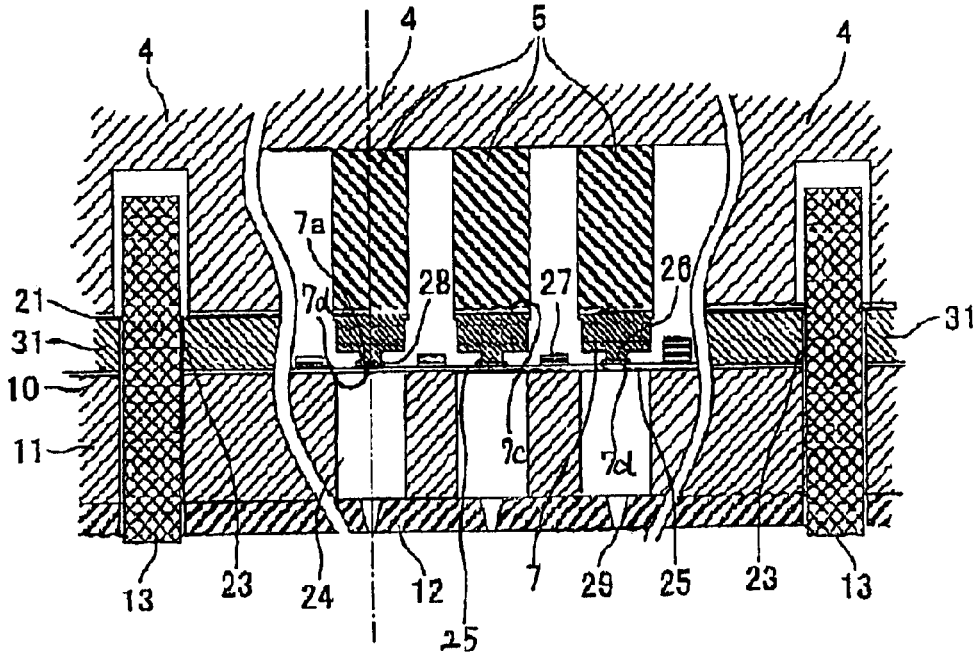
FIG. 4 is a front cross-sectional view showing the ink jet head of FIG. 1.

As shown in FIG. 2, an ink jet head 22 can be divided mainly into a channel portion 15 and a drive portion 14. As shown in FIGS. 2, 3, and 4, the channel portion 15 includes a reinforcement plate 8, a diaphragm plate 10, a chamber plate 11, and an orifice plate 12. As shown in FIG. 4, the orifice plate 12 is formed with a plurality or nozzles 29 aligned in a row. The direction in which the nozzles 29 are aligned with be referred to as the nozzle alignment direction hereinafter. The chamber plate 11 includes ink chambers 24. The diaphragm plate 10 includes diaphragm sections 25 in a one-to-one correspondence with the ink chambers 24. The reinforcement plate 8 increases overall stiffness of the channel portion 15 and also improves soundness of adhesion between diaphragm sections 25 and elongated relay members 7 of the drive portion 14.

The drive portion 14 includes the elongated relay members 7, piezoelectric actuators 5, a support plate 4, a copper-foiled ceramic plate 2, and a flexible print circuit 1. The relay members 7 and the piezoelectric actuators 5 are aligned in the nozzle alignment direction and positioned in a one-to-one correspondence with the ink chambers 24 of the chamber plate 11. The copper-foiled ceramic plate 2 and the flexible print circuit 1 are for transmitting signals. Also, two intermediate members 31 are provided, one at either end of the row of relay members 7 with respect to the nozzle alignment direction.

As shown in FIG. 4, each of the relay members 7 includes a top end 7*c* at its upper side and a protrusion portion 7*a* at its lower side. Each protrusion portion 7*a* has a narrower width in the nozzle alignment direction than the top end 7*c*. Also, each protrusion portion 7*a* includes a first abutment surface 7*d* that abuts the diaphragm sections 25 along a distance that is narrower than the corresponding ink chambers 24 with respect to the nozzle alignment direction. The top end 7*c* of each relay members 7 defines a second abutment surface that is connected to the corresponding piezoelectric actuator 5 along a distance that is substantially the same as the width of the corresponding piezoelectric actuator 5. A reference hole 23 is formed in each of the intermediate members 31. A second reference pin 13 is inserted through each of the reference holes 23. The reference holes 23 and the second reference pins 13 align the relay members 7 with the ink chambers 24 so that the center position of each first abutment surface 7*d* is aligned with an imaginary center line (indicated by single dot chain line in FIG. 4) of the corresponding ink chamber 24.

It is desirable that the intermediate members 31 be formed with a thickness substantially equal to or less than the thickness of the relay members 7 to improve adhesion of the relay members 7 to the diaphragm sections 25. If the intermediate members 31 are formed thinner than the relay members 7, then the relay members 7 will apply a constant slight load to the diaphragm sections 25 even before the piezoelectric actuators 5 are driven.

The relay members 7 are adhered to the diaphragm sections 25 by adhesive 28. As shown in FIG. 4, the first abutment surface 7*d* of each protrusion portion 7*a* is formed adhesive escape holes 26. The adhesive escape holes 26 prevent the adhesive 28 from running onto the diaphragm sections 25 and reducing ink ejection performance and consistency.

The piezoelectric actuators 5 extend or contract when applied with an electric signal, resulting in positional displacement. This displacement is transmitted to the diaphragm sections 25 through the elongated relay members 7, resulting in a pressure fluctuation in the ink chambers 24. The pressure fluctuation ejects ink in the ink chambers 24 through the nozzles 29 at an ejection speed of around 10 m/s.

The relay members 7 are positioned with great precision with respect to the ink chambers 24. Even though the piezoelectric actuators 5 may be slightly out of alignment, the displacement generated by the piezoelectric actuators 5 will always be transmitted through the relay members 7 to the same position of the center of the ink chambers 24 and across the same surface area of the diaphragm sections 25. Therefore, as will be described later, the positioning of the relay members 7 to the ink chambers 24 is given priority over positioning of the piezoelectric actuators 5 and the diaphragm plate 10 to the ink chambers 24.

Table 1 lists various materials and methods that can be used to produce the relay members 7. It should be noted that the intermediate members 31 are produced using the same materials as the relay members 7.

TABLE 1

| Material | Method |
|---|---|
| Silicon, stainless steel, iron-nickel alloy | Etching, a combination of etching and cutting, or, when an iron-nickel alloy is used, powder metallurgy |
| Highly rigid resin (such as an epoxy resin) | Molding or a combination of molding and cutting |
| Ceramics and glass | Cutting |
| Iron, nickel, chromium, zinc, tin, indium, gold, silver, copper, platinum, palladium, iridium, or an alloy including any of these. | Electroforming, a combination of electroforming and cutting, powder metallurgy, or a combination of powder metallurgy and cutting |

The relay members 7 is desirably made from silicon for two reasons: silicon is extremely hard and reference holes 23 can be formed with great precision. The greater the hardness of the relay members 7, the better their sensitivity in transmitting displacement and vibration to the piezoelectric actuators 5. Silicon has a hardness that is more than twice the hardness of metal, so even slight amplitudes can be transmitted with great efficiency.

If the materials relay members 7 are formed using electroforming, then it is preferable to add sulfur, carbon, phosphorus, or boron to the material used in the electroforming process. The materials listed in Table 1 for use when forming the relay members 7 by electroforming have a low hardness, and can easily corrode because of their poor chemical stability. Addition of sulfur, carbon, or phosphorus increases the hardness of metal and addition of boron improves resistance to corrosion.

Next, a method of manufacturing the ink jet head 22 according to the first embodiment will be explained.

Figure 5A:
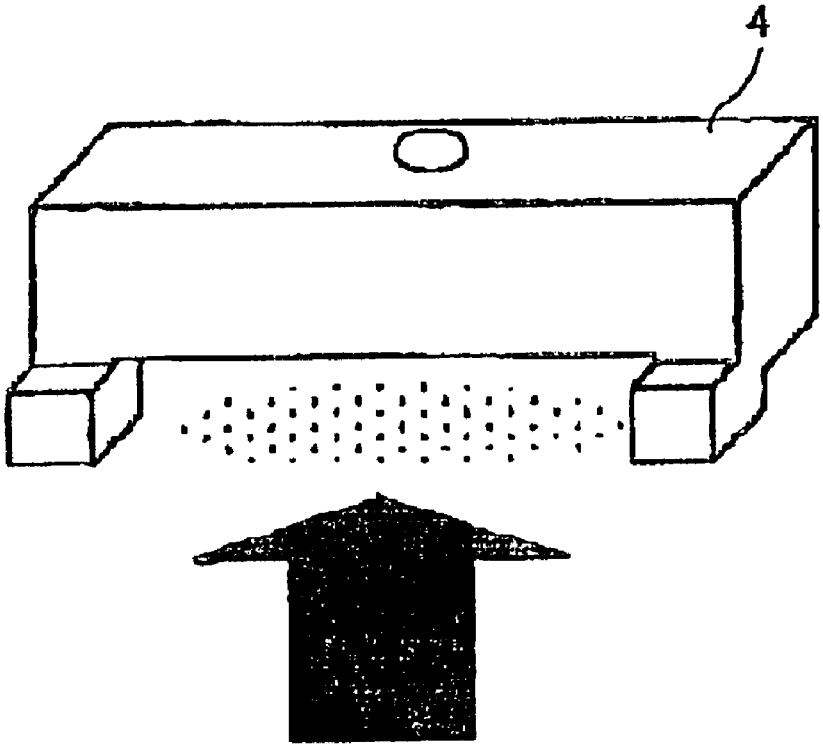
FIG. 5(*a*) is a perspective view showing a step of applying insulation material to a support block according to a production method of the ink jet head of the first embodiment.
Figure 5B:
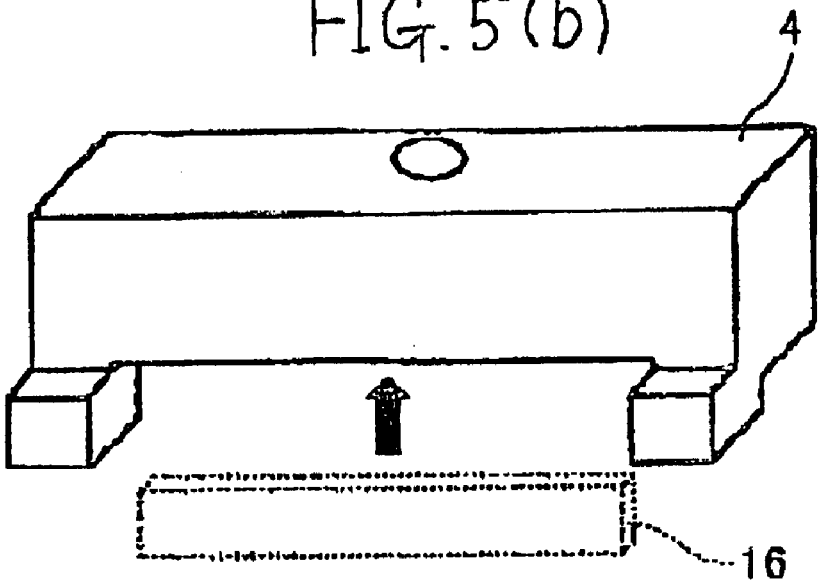

First, the support plate 4 is formed from a stiff member having a property that prevents vibration. An example material for forming the support plate 4 is SUS 430. Next, as shown in FIG. 5(*a*), $SiO_2$ is sputter deposited on an inner surface of the support plate 4 (a bottom surface of the support plate 4 in FIG. 5(*a*)), to form an insulation layer 20 from $SiO_2$ to a thickness of about 500 nm. Then, as shown in FIG. 5(*b*) a piezoelectric block 16 is aligned with the edge of the support plate 4 and adhered in place. Either a $d_{33}$ type or a $d_{31}$ type can be used as the piezoelectric block 16. The $d_{33}$ type generates displacement that is parallel with an applied electric field and the $d_{31}$ type generates displacement that is perpendicular to the applied electric field. The $d_{33}$ type has the advantage that signal lines from an external electrode 18 are easier to connect.

Figure 6:
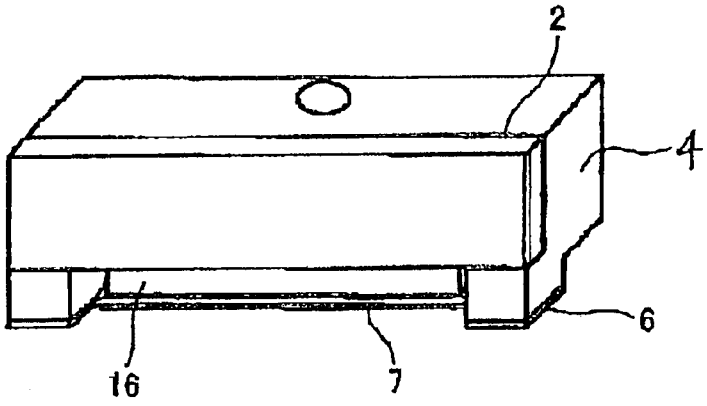
FIG. 6 is a perspective view showing a step for adhering a relay plate and a copper-foiled ceramic plate according to the production method of the ink jet head of the first embodiment.
Figure 7:
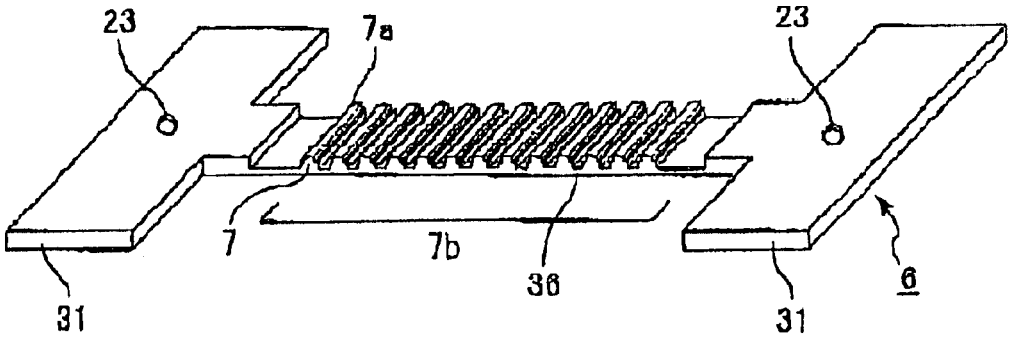
FIG. 7 is a perspective view showing a first example of the relay plate according to the first embodiment.
Figure 8:
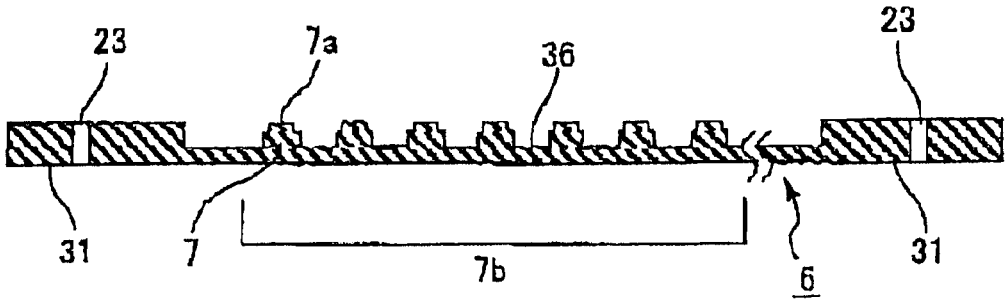
FIG. 8 is a cross-sectional view of the relay plate shown in FIG. 7.

After the piezoelectric block 16 is attached to the support plate 4, then as shown in FIG. 6 the copper-foiled ceramic plate 2 and a relay plate 6 are connected to the support plate 4. The relay plate is shown in FIGS. 7 and 8. The relay plate 6 includes a connection region 7*b* formed integrally with the intermediate members 31. The connection region 7*b* includes the relay members 7 and connection portions 36. The relay members 7 include the protrusion portion 7*a*. The connection portions 36 connect adjacent relay members 7 and separate the relay members 7 by a distance equivalent to the distance between adjacent ink chambers 24. The intermediate members 31 are formed with the reference holes 23, which assist in aligning the relay members 7 on the imaginary central line of the corresponding ink chambers 24 as will be described later.

Figure 9:
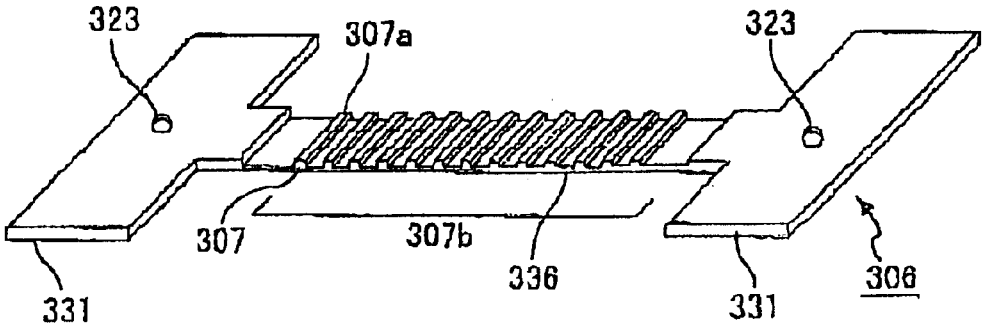
FIG. 9 is a perspective view showing a second example of the relay plate according to the first embodiment of the present invention.
Figure 10:
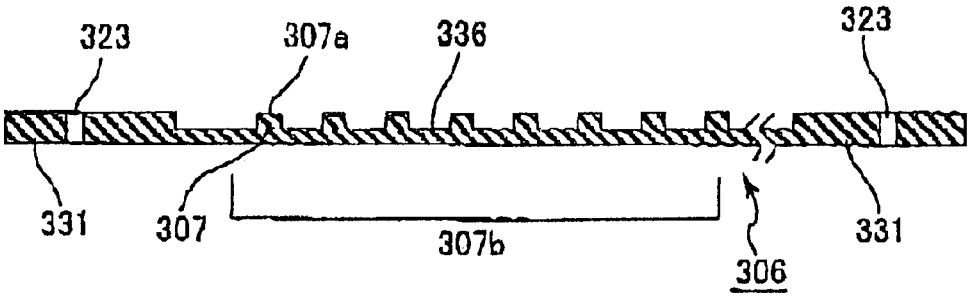
FIG. 10 is a cross-sectional view showing the relay plate of FIG. 9.

It should be noted that modifications of the relay plate 6 may be used instead of the relay plate 6. For example, FIGS. 9 and 10 show a thin relay plate 306 that may be used when the relay plate is made from a hard material such as silicon. Although the thin relay plate 306 is not provided with any protrusion portions 7*a*, it functions sufficiently well when the relay plate is made from a hard material such as silicon. The thin relay plate 306 is desirable for use in structures with a highly dense nozzle arrangement because of its simpler configuration.

Figure 11:
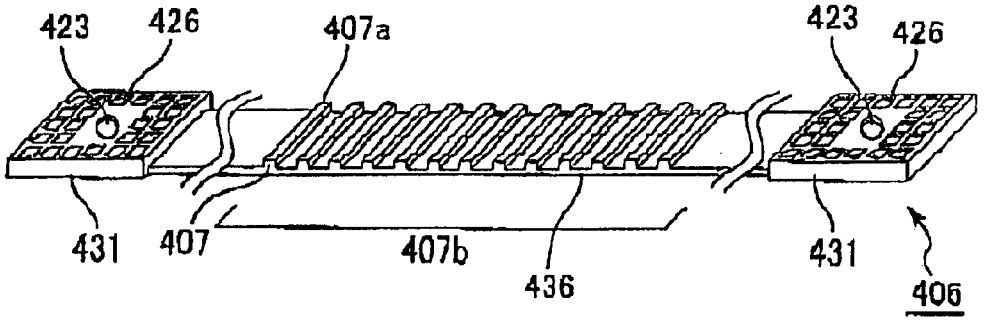
FIG. 11 is a perspective view showing a third example of the relay plate according to the first embodiment of the present invention.
Figure 12:
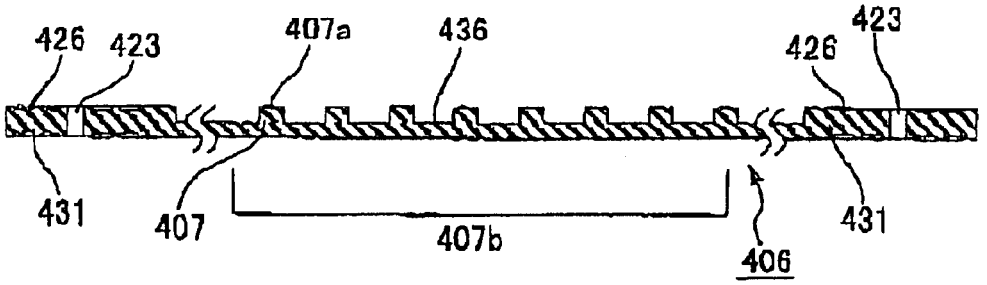
FIG. 12 is a cross-sectional view showing the relay plate of FIG. 11.

FIGS. 11 and 12 show a relay plate 406 that may be used instead of the relay plate 6. The relay plate 406 includes intermediate members 431 formed with adhesive escape holes 426 in order to increase adhering strength.

Figure 13:
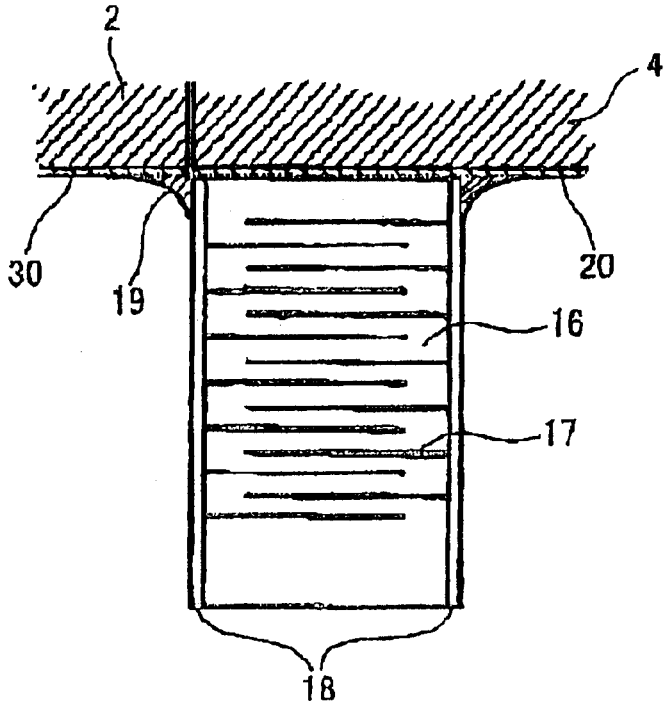
FIG. 13 is a cross-sectional view showing a step of forming electrical connection wires of the piezoelectric block according to the production method of the ink jet head of the first embodiment.

Next, as shown in FIG. 13, conductive paste 19 is applied where the piezoelectric block 16 is adhered to the support plate 4 to electrically connect the external electrode 18 of the piezoelectric block 16 and a copper foil layer 30 of the copper-foiled ceramic plate 2.

Figure 14:
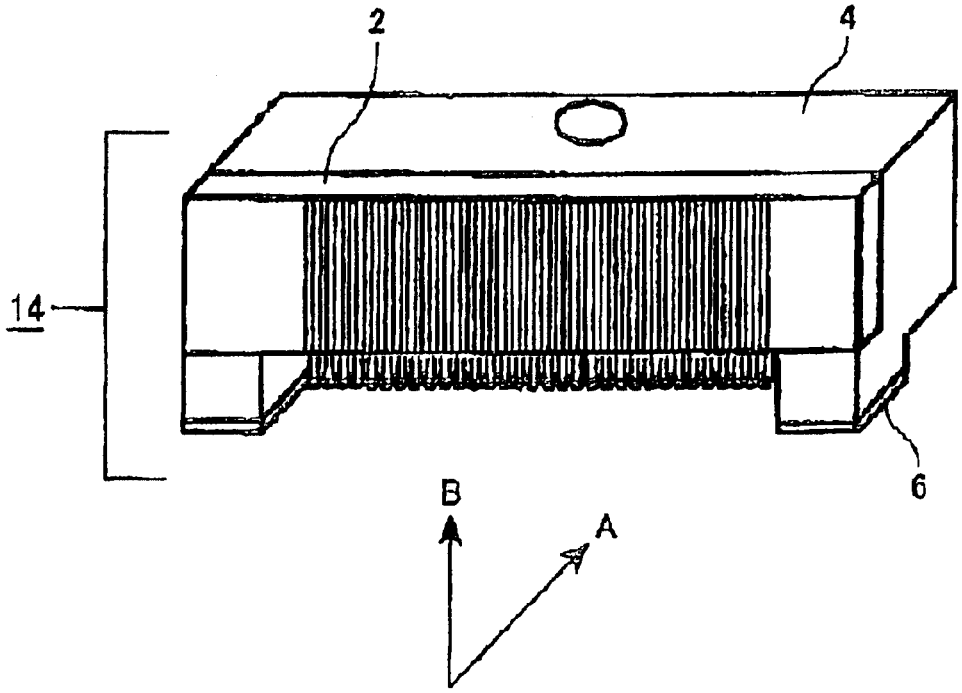
FIG. 14 is a perspective view showing a step of cutting the piezoelectric block and the copper-foiled ceramic plate according to the production method of the ink jet head of the first embodiment.

Next, as shown in FIG. 14 the relay plate 6 and the piezoelectric block 16 are cut simultaneously following a first cut direction A (front-to-rear) to divide the relay plate 6 into the intermediate members 31 and the individual relay members 7 and to divide the piezoelectric block 16 into the individual piezoelectric actuators 5. Afterward, the copper-foiled ceramic plate 2 is cut following a second cut direction B (downward-to-upward). Because the relay plate 6 and the piezoelectric block 16 are strongly adhered to the support plate 4 in advance, the positional relationship of the relay members 7 and the reference holes 23 with other components will remain unchanged during the cutting processes. Accordingly, each relay member 7 will be maintained in the precise alignment with the imaginary central line of the corresponding ink chamber 24 that was established by the reference holes 23 and the second reference pins 13.

It should be noted that the piezoelectric block 16, the relay plate 6, and the copper-foiled ceramic plate 2 need not be cut in the order described above. That is, the copper-foiled ceramic plate 2 may be cut first following the second cut direction and then, afterward, the piezoelectric block 16 may be cut following the first cut direction to produce the individual piezoelectric actuators 5. This order will not be detrimental to manufacturing operations in any way.

Figure 15:
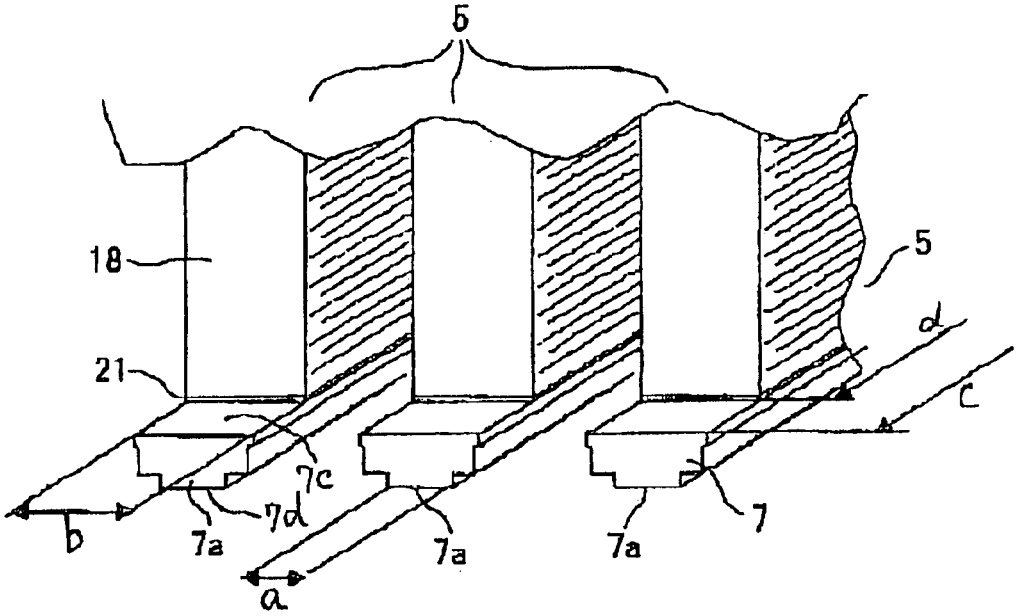
FIG. 15 is a magnified perspective view showing the tip ends of the piezoelectric actuators.

FIG. 15 shows the condition of components around the tips of the piezoelectric actuators 5 after the piezoelectric actuators 5 are cut. Dimensions a, b, c, and d indicated in FIG. 15 relate to the adhesion surfaces of the relay members 7. Dimensions a and b are widthwise dimensions in the nozzle alignment direction and dimensions c and d are lengthwise dimensions in a direction perpendicular to the nozzle alignment direction. The dimension a is the width of the region where each relay member 7 is adhered to the corresponding diaphragm section 25. Dimension b is the width or the region wherein each relay member 7 is adhered to the corresponding piezoelectric actuator 5. The dimension c is the length of the region where each relay member 7 is adhered to the corresponding diaphragm section 25. Dimension d is the length of the region where each relay members 7 is adhered to the corresponding piezoelectric actuator 5.

The top end 7*c* of each relay member 7 adhered to the lower zip of the corresponding piezoelectric actuator 5 has substantially the same width in the nozzle alignment dimension as the corresponding piezoelectric actuator 5. However, because each protrusion portion 7*a* has a narrower width in the nozzle alignment direction than the top end 7*c*, dimension a is less than dimension b, that is:

$$a<b \tag{1}$$

Because of relationship of equation (1), it is both achieved that each of the piezoelectric actuators 5 has a sufficiently large capacitance and that the nozzles can be arranged close together. It should be noted that dimension a is desirably about one third the width of one of the ink chambers 24 to insure a maximum amount of displacement in the diaphragm sections 25. Dimension b should be as broad as possible in order to secure a proper capacitance in each of the piezoelectric actuators 5. With this relationship, the piezoelectric actuators 5 can generate a force for ejecting ink droplets with a sufficient volume, even in an ink jet head with a highly dense structure of 75 dpi or greater.

Figure 16:
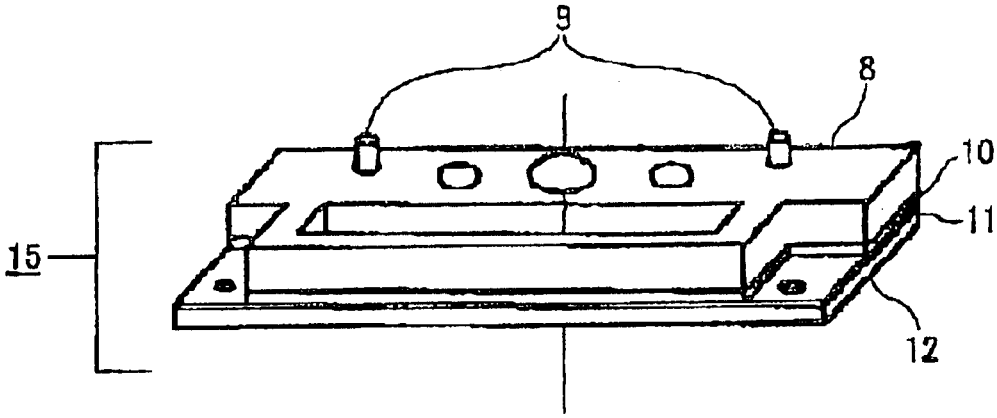
FIG. 16 is a perspective view showing channel portion of the ink jet head according to the first embodiment.

Next, the channel portion 15 is assembled by adhering the reinforcement plate 8, the diaphragm plate 10, the chamber plate 11, and the orifice plate 12 together as shown in FIG. 16 using sheets of adhesive (not shown). It should be noted that during the adhesion process, first reference pins 9 are used to position the reinforcement plate 8, the diaphragm plate 10, the chamber plate 11, and the orifice plate 12 of the channel portion 15 with respect to each other.

Figure 17:
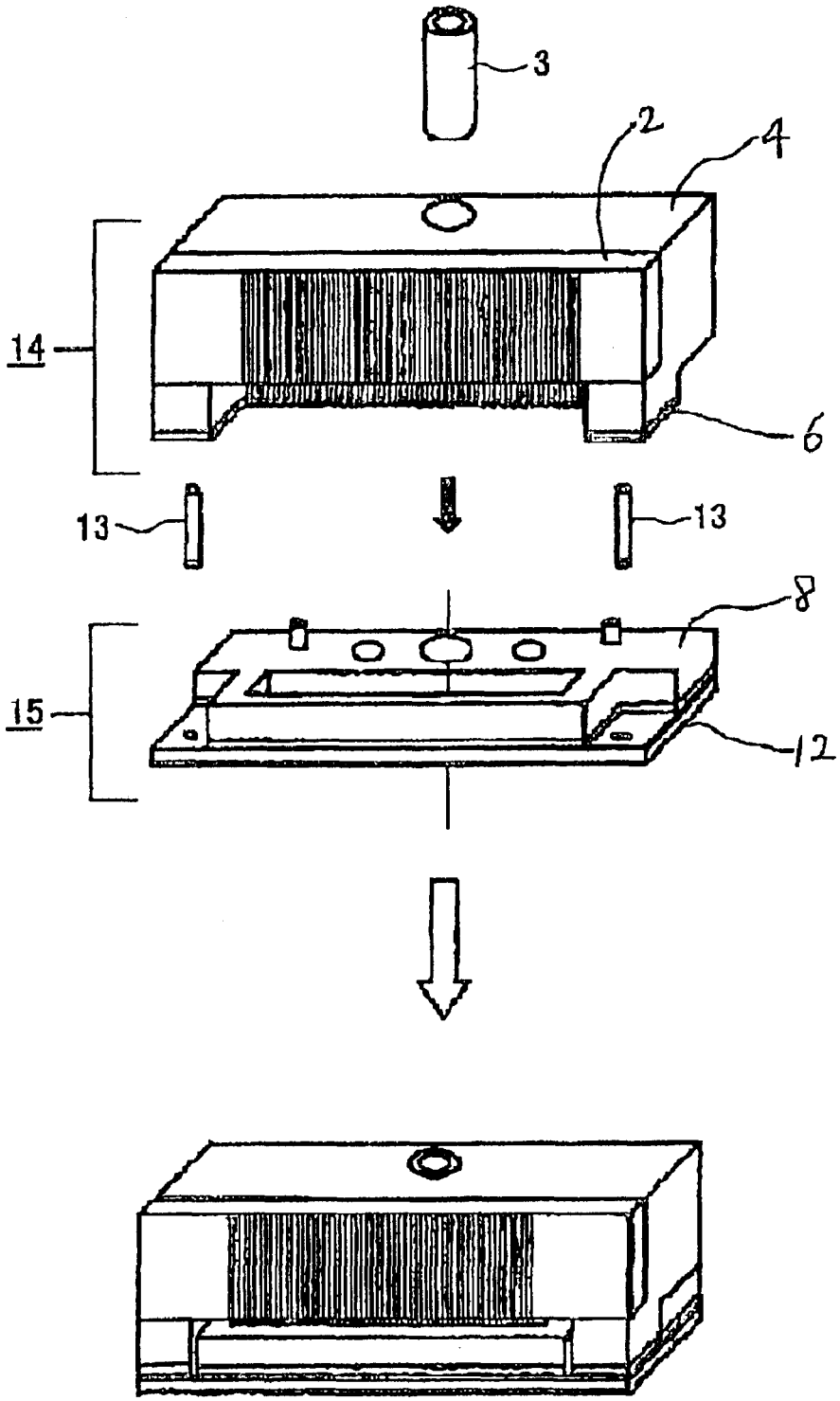
FIG. 17 is a perspective view showing a step of coupling the channel portion to a drive portion according to the production method of the ink jet head of the first embodiment.

Next, the drive portion 14 and the channel portion 15 are connected together. First, an adhesive that cures at room temperature is coated on one or both confronting surfaces of the drive portion 19 and the channel portion 15. Then, as shown in FIG. 17, the channel portion 15 and the drive portion 14 are aligned using the second reference pins 13 and connected together using the adhesive. Further, an ink supply tube 3 is inserted into a hole formed in the center of the drive portion 14.

Figure 1:
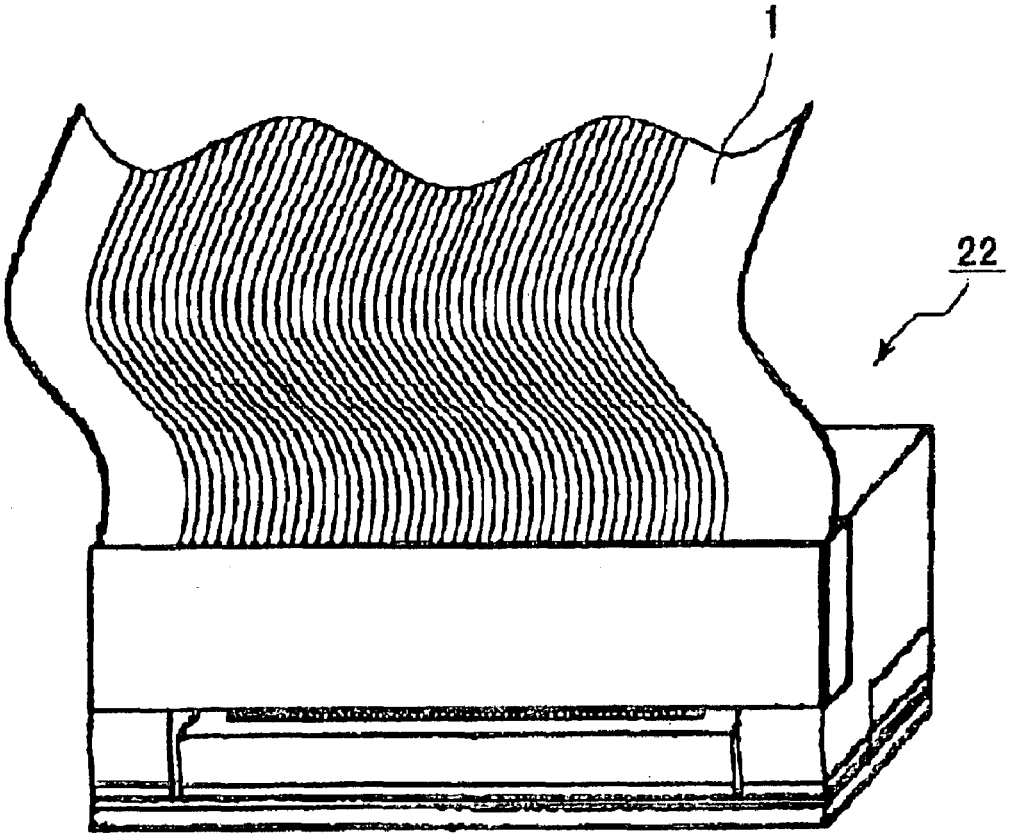
FIG. 1 is a perspective view showing an ink jet head according to a first embodiment of the present invention.

Finally, the flexible print circuit 1 is connected to the copper-foiled ceramic plate 2 to complete production of the ink jet head 22 shown in FIG. 1.

Figures 18A, 18B, 18C, 18D, 18E, 18F, 18G, 18H, 18I, 18J:
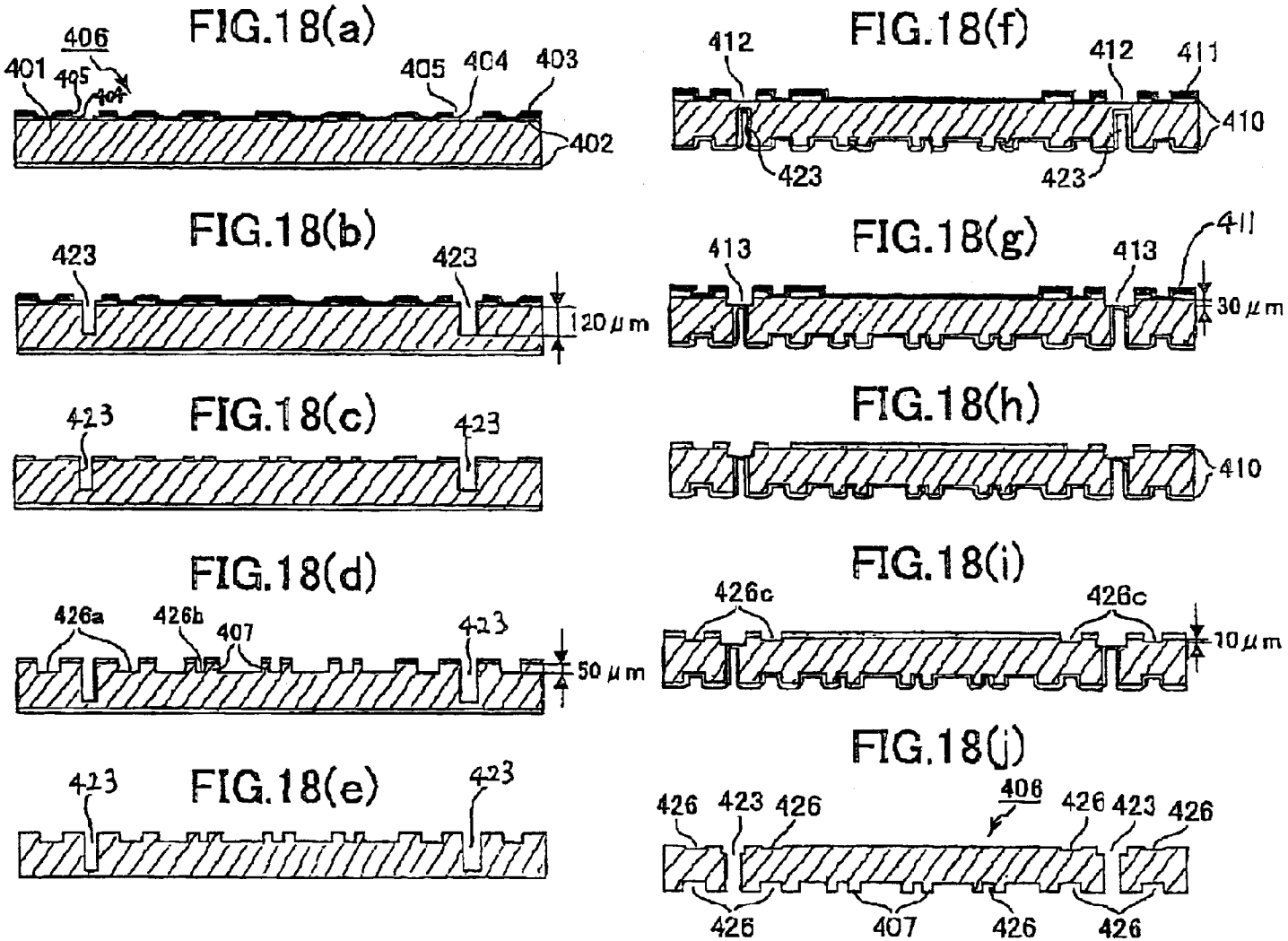
FIG. 18(*a*) is a cross-sectional view showing a first step in producing the relay plate according to a first production method.
Figure 19A:
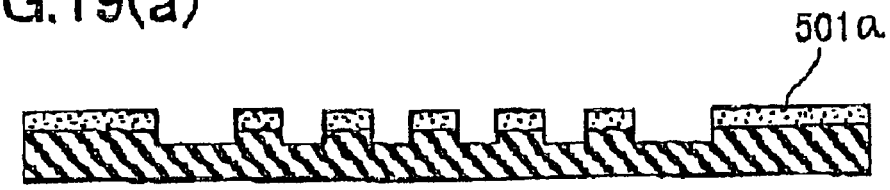
FIG. 19(*a*) is a cross-sectional view showing a first step in producing the relay plate according to a second production method.
Figure 19B:
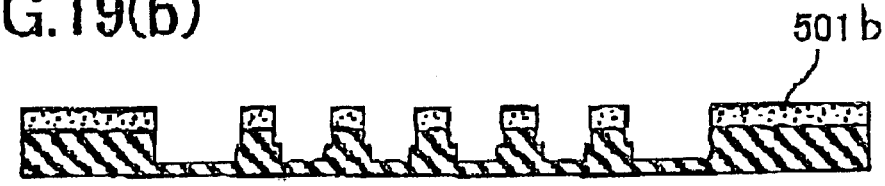
Figure 19C:
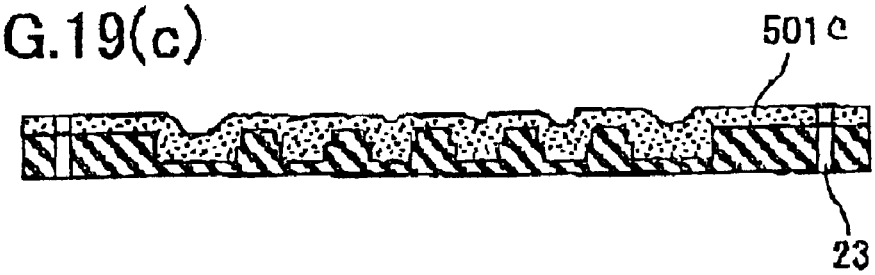
Figure 19D:
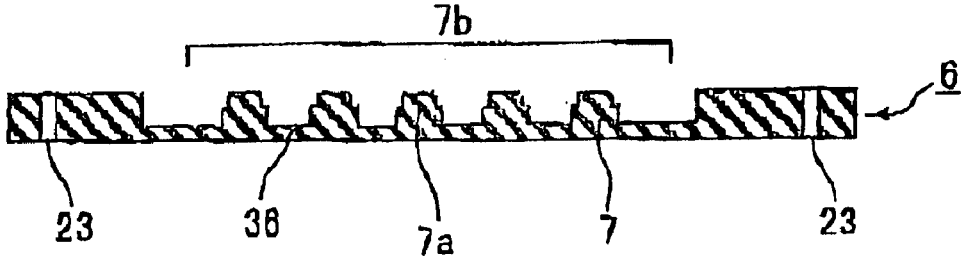
Figure 20A:
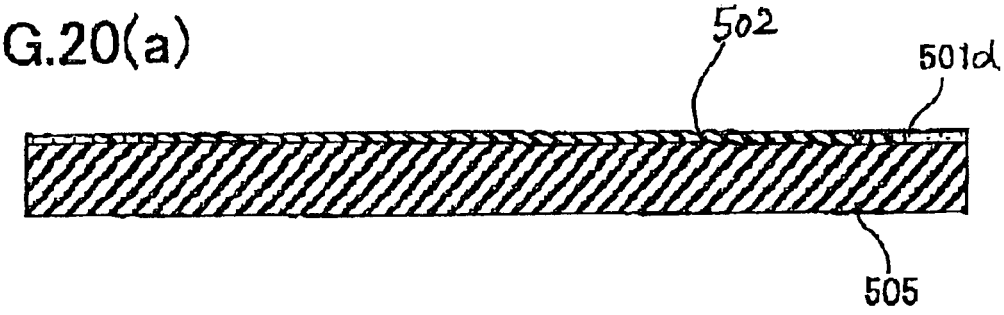
FIG. 20(*a*) is a cross-sectional view showing a first step in producing the relay plate according to a third production method.
Figure 20B:
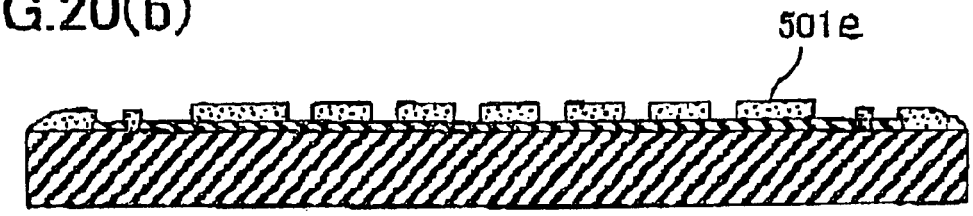
Figure 20C:
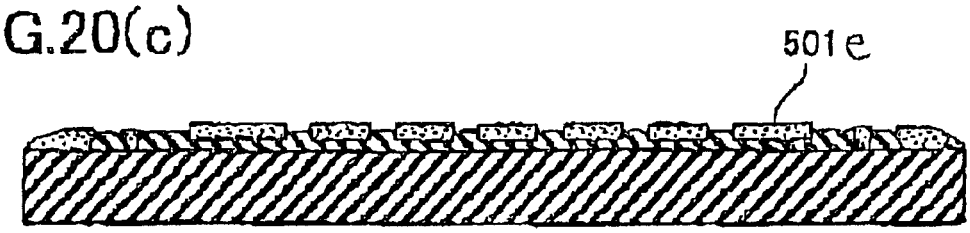
Figure 20D:
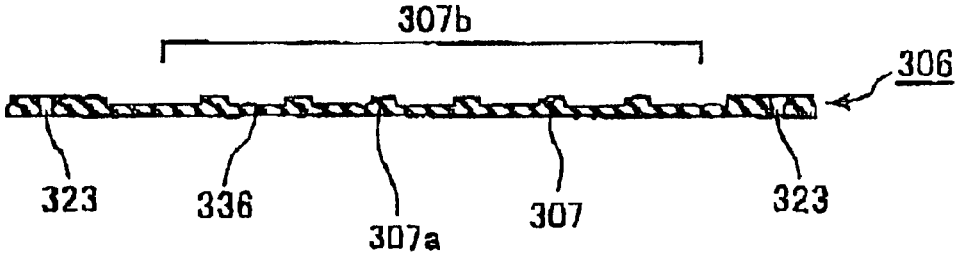

Next, methods for producing the relay plates 6, 306, 406 will be described. FIGS. 18(*a*) to 18(*j*) represent a first production method for producing the relay plate 406 from silicon using photolithography. The FIGS. 18(*a*) to 18(*j*) show cross-sectional views of the relay plate 406 during different stages of the first production method.

FIG. 18(*a*) shows a process of forming a two-layer mask. A (100) plane silicon wafer 401 is prepared with a thickness of about 200 microns. Hereinafter, the upper surface of the silicon wafer 401 as viewed in FIGS. 18(*a*) to 18(*e*) will be referred to as the first surface and lower surface as viewed in FIGS. 18(*a*) to 18(*e*) will be referred to as the second surface.

The silicon wafer 401 is subjected to steam oxidation at 1150° C. to form a $SiO_2$ film 402 to a thickness of about 1.0 to 2.0 microns on both the first and second surfaces. Next, using photolithography, a pattern including holes 404 is formed in the $SiO_2$ film 402 located on the first surface of the silicon wafer 401 by washing away selected portions with a hydrofluoric acid solution. The pattern forms a first layer etching mask for forming reference holes 423 in the process shown in FIG. 18(*b*) and adhesive escape holes 426*a*, 426*b* and relay members 407 in the process shown in FIG. 18 (*d*).

Next, an Al film 403 is deposited on the first layer etching mask using sputtering. The Al film 403 is deposited to a thickness or 1 micron or less. Then, using photolithography, a pattern including holes 405 is formed in the Al film 403 by washing away selected portions with a 1% hydrofluoric acid solution. This pattern forms a second layer etching mask for forming the reference holes 423.

The two layer etching mask is formed such that the hole 405 in the Al film 403 has a larger diameter than the hole 404 in the $SiO_2$ film 402 in order to allow for variations in any positional shift in the photo mask during photolithography. Described in more detail, the diameter of the hole 405 is desirably 10 or more microns larger than the diameter of the hole 404. However, positional shift of the photo mask depends on the photolithography equipment, so the diameters of the holes 404, 405 can be get to whatever values are most appropriate for the photolithography equipment used.

Next, the reference holes 423 are formed in the silicon wafer 401 as shown in FIG. 18(*b*). That is, the silicon wafer 401 is placed in a High Frequency Inductively Coupled Plasma Reactive Ion Etching (ICP-RIE) apparatus and subjected to dry etching to form the reference holes 423 to a depth of about 120 microns. At this time, although the Al film 403 on the first surface of the silicon wafer 401 serves as a mask, the $SiO_2$ film 402 is partially exposed through the holes 405 in the Al film 403. Therefore, the diameter of the reference holes 423 is determined by the diameter of the holes 404.

Next, as shown in FIG. 18(*c*), the second layer formed by the Al film 403 is removed to expose the first layer formed by the $SiO_2$ film 402. The Al film 403 is washed off by a 1% hydrofluoric acid solution. Then, as shown in FIG. 18(*d*), the adhesive escape holes 426*a*, 426*b* and the relay members 407 are formed in the silicon wafer 401 to a depth of about 50 microns by etching. The reference holes 423 are further deepened at this time, so that by the end of the process of FIG. 18(*d*) the reference holes 423 have a depth of 170 (=120+50) microns. As shown in FIG. 18(*e*) the $SiO_2$ film 402 is then removed from both the first and second surface of the silicon wafer 401 using a hydrofluoric acid solution.

Next, processes are performed on the second surface of the silicon wafer 401. The positions of the first and second surfaces are reversed in FIGS. 18(*f*) to 18(*j*), so that the second surface is shown on top and the first surface is shown on the bottom.

As shown in FIG. 18(*f*), a $SiO_2$ film 410 is formed on both the first and second surfaces of the silicon wafer 401. The $SiO_2$ film 410 is formed by thermal oxidation to a thickness of 0.1 to 1.5 microns in a manner similar to the process described with reference to FIG. 18(*a*). Then, using photolithography, a pattern is formed in the $SiO_2$ film 410 an the second surface of the silicon wafer 401 using a hydrofluoric acid solution. The pattern serves as a first layer etching mask for forming the reference holes 423 and adhesive escape holes 426*c*. Afterward, an Al film 411 is formed on the first layer etching mask using sputtering. The Al film 411 is formed to a thickness of 1 micron or less. Then using photolithography, a pattern is formed in the Al film 411 using a 1% hydrofluoric solution. The pattern serves as a second layer etching mask for forming the reference holes 423.

Both of the layers 410, 411 are formed with openings 412 for forming the reference holes 423. Each hole 412 is formed with a larger diameter that is 10 micron larger than the diameter of the actual reference holes 423. Because the diameter of the holes 412 is larger than the actual reference holes 423, the portion of the reference holes 423 nearer the second surface will always be formed across a range that encompasses the entire cross-sectional area of the portion of the reference holes 423 nearer the first surface, even if the photo masks shift during photolithography so that the centers of the holes 412 shift from the centers of reference holes 423. Because the second surface portion encompasses the first surface portion of the reference holes 423, the inner periphery of the second surface portion of the resultant reference holes 423 will not interfere with insertion or positioning of the second reference pins 13 and actual positioning is performed by the first surface portion of the reference holes 423 formed in the process of FIG. 18(*b*). In this way, the holes 404 determine the functioning diameter of the reference holes 423.

As shown in FIG. 18(*g*), position holes 413 are formed into the silicon wafer 401 using the second layer Al film 411 as a mask. The positioning holes 413 are formed by dry etching until reaching the $SiO_2$ film 410 on the first surface, which is a depth of about 30 microns in the present embodiment. Next, over-etching is performed to remove burrs that remain on the boundary between the base and side walls of the positioning holes 413. Note that the $SiO_2$ film 410 formed on the first surface is not easily removed by the over-etching.

While the second surface is being subjected to dry etching during process of FIG. 18(*g*), helium gas is introduced into the space at the first side of the silicon wafer 401 for cooling purposes. The SiO2 film 410 on the first surface serves to prevent or suppress leakage of the helium gas to the second surface side. There is a risk that the silicon wafer 401 will not be sufficiently cooled if a large amount of helium leaks to the second surface side while dry etching is being performed. Excessive heat can affect the etched portion so that its cross-sectional shape is not as desired. For example, the side wall surface can develop a slant. It should be noted that portions of the first surface side SiO2 film 410 can rupture under pressure from the helium when the SiO2 film 410 has a thickness of less than 1.0 microns. However, experiments have confirmed that the SiO2 film 410 will not rupture and helium will not leak when the SiO2 film 410 has a thickness of 1.0 microns or greater.

Next, as shown in FIG. 18(*h*), the second layer Al film 411 is removed to expose the first layer SiO2 film 410 as the second surface. The Al film 411 is removed using a 1% hydrofluoric acid solution. As shown in FIG. 18(*i*), adhesive escape holes 426*c* are formed by dry etching. The adhesive escape holes 426*c* are formed to a depth of about 10 microns. At the same time, positioning holes 413 are subjected to over-etching as will be described later. As shown in FIG. 18(*j*), next the SiO2 film 410 is removed by washing in a hydrofluoric acid solution. Finally, the silicon relay plate 406 is thermally oxidized to form a SiO2 film of about 0.2 to 0.5 microns. This SiO2 film increases the anti-corrosion property of the relay plate 406 and also adherence by adhesive. This completes the relay plate 406.

Next, the over-etching process will be explained. When dry etching the second surface positioning holes 413 in the process represented in FIG. 18(*g*), the peripheral portions of the positioning holes 413 are removed at a slightly slower etching rate than the center of the positioning holes 413. Therefore, burrs can remain at the periphery portion after the center has been removed through to the other side. Therefore, etching needs to be continued for a time after the positioning holes 413 have been opened through to the reference holes 423. This is referred to as over-etching. Accordingly, to take over-etching into consideration, dry etching is performed for longer than needed to merely form the positioning holes 413. Said differently, the etching depth of the positioning holes 413 on the second surface is set larger than is actually needed. Although the amount of over-etching varies depending on the conditions of the dry etching device at the time of etching, an over-etching amount of 20 microns to 80 microns is considered to be desirable.

According to the present embodiment, the over-etching amount for removing burrs is set to 40 microns. Accordingly, the dry etching process shown in FIG. 18(*g*) for the positioning holes 413 is performed for a time required to produce a total etching depth of 70 microns, that is, the 30 microns for the actual etching depth of the positioning holes 413 plus 40 microns for the over-etching amount. Further, during the process shown in FIG. 18(*i*), 10 microns worth of over-etching is performed simultaneously with the dry etching performed to form the adhesive escape hole 426*c* to a depth of 10 microns.

Although an Al film is used as the second layer etching mask in the example shown in FIGS. 18(*a*) to 18(*j*), a $SiO_2$ film formed by thermally oxidizing the wafer can be used as the second layer etching mask instead. In this case, the two-layer mask includes two films of thermally oxidized silicon ($SiO_2$). However, the pattern precision will be slightly lower with this configuration. Although this potential problem needs to be taken into consideration, the same production method can be used as for when the second layer is an Al film.

Also, the first surface of the relay plate 406 is processed before the second surface of the relay plate 406 in the example shown in FIGS. 18(*a*) to 18(*j*). However, the second surface of the relay plate 406 can be processed first and the first surface processed afterward using the same processes as described in the embodiment.

The relay plate 406 can be prepared with high precision using the example method shown in FIGS. 18(*a*) to 18(*j*). In particular, the reference holes 423 of the relay plate 406 is formed using the same mask as used for etching the relay members 407, so the reference holes 423 will be properly and precisely positioned with respect to the relay members 407.

Next, a second method will be described with reference to FIGS. 19(*a*) to 19(*d*). The second method is for producing the relay plate 6. First, as shown in FIG. 19(*a*), a resist 501*a* is formed on an H-shaped plate (see FIG. 7) in a pattern for forming the wider dimension of the relay members 7, that is, the piezoelectric actuator side of the relay members 7 to the width of dimension b shown in FIG. 15. Then, an initial etching is performed. Next, as shown in FIG. 19(*b*), a resist 501*b* is formed for forming the protrusion portions 7*a* of the relay members 7 with the narrower dimension a. Then, etching is again performed to form the relay members 7 and the protrusion portion 7*a*. Next, as shown in FIG. 19(*c*), a resist 501*c* is formed, this time with holes at positions corresponding to the reference holes 23. Then etching is performed to form the references holes 23. Finally, as shown in FIG. 19(*d*) the resist 501*c* is removed, thereby completing the relay plate 6.

Next, a third method will be described with reference to FIGS. 20(*a*) to 20(*d*). The third method is for producing the thin relay plate 306 by electroforming. First, as shown in FIG. 20(*a*), a resist 501*d* is formed in a desired pattern including at least portions corresponding to the reference holes 323. Then a plating layer 502 is formed using electroforming. As shown in FIG. 20(*b*), a resist 501*e* is formed in a pattern that exposes portions that correspond to the protrusions 307*a* or the relay members 307. Said differently, the portions that correspond to the protrusions 307*a* are surrounded by the resist 501*e* pattern. As shown in FIG. 20(*c*), electroforming is performed in the same manner as in the process shown in FIG. 20(*a*) to form a plating layer at portions that correspond to the protrusion portions 307*a* of the relay member 307. After the relay plate 306 is formed on the substrate 505 in this way, the resists 501*d*, 501*e* are removed to complete the relay plate 306. It should be noted that normally the thickness of the thin relay plate 306 is limited to only about 100 microns when produced using electroforming.

Figure 21A:
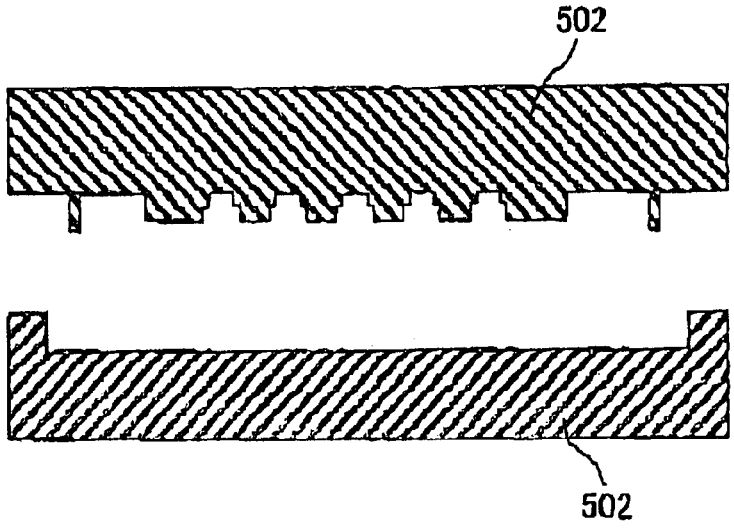
FIG. 21(*a*) is a cross-sectional view showing a first step in producing the relay plate according to a fourth production method.
Figure 21B:
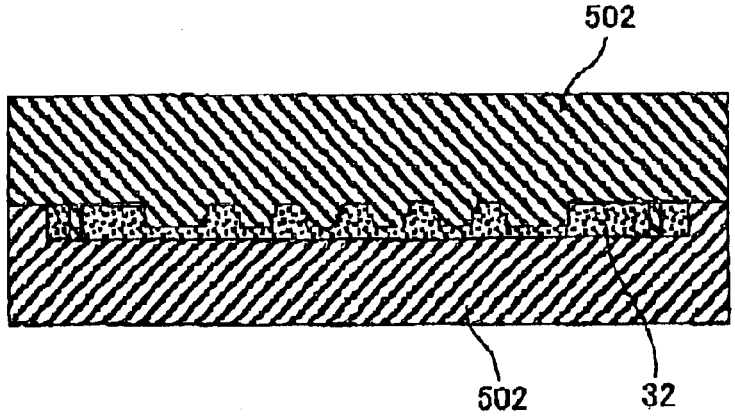
Figure 21C:
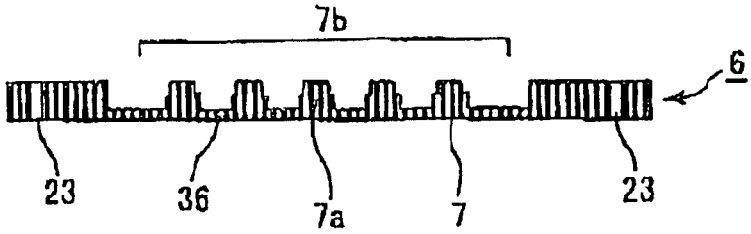
Figure 22A:
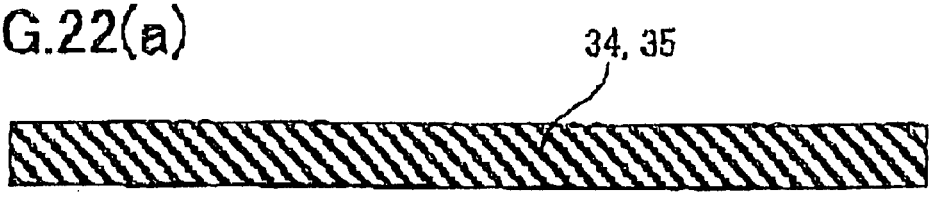
FIG. 22(*a*) in a cross-sectional view showing a first step in producing the relay plate according to a fifth production method.
Figure 22B:
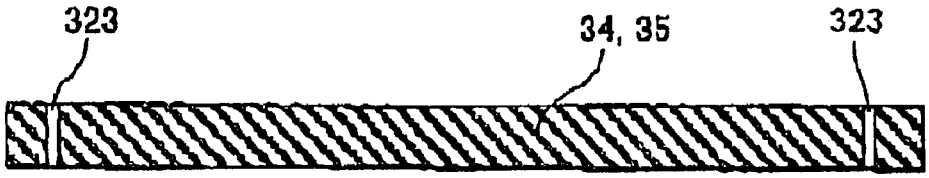
Figure 22C:
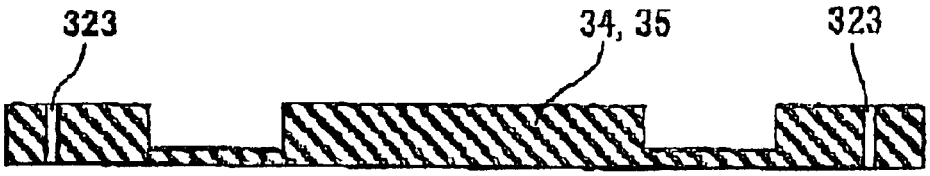
Figure 22D:
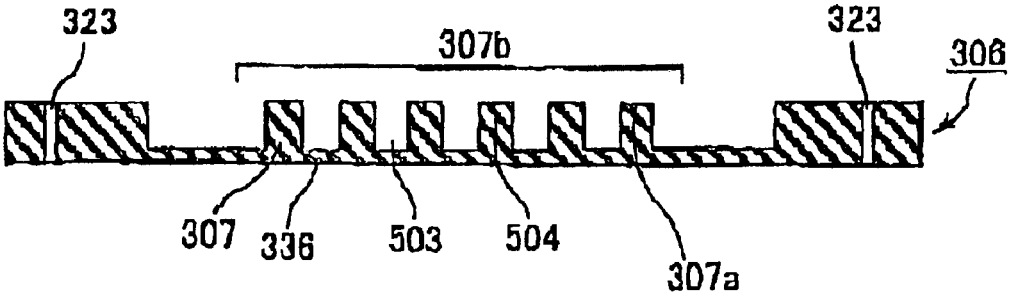

Next, a fourth method will be described while referring to FIGS. 21(*a*) to 21(*c*). The fourth method is for producing the relay plate 6 using powder metallurgy or a mold. As shown in FIG. 21(*a*) a highly precise metal mold 502 is first prepared. The metal mold 502 is produced using electroforming or electron discharge machining. As shown in FIG. 21(*b*), resin 32 (or metal powder) is injected into the metal mold 502 and allowed to cure (or compressed). After the resin 32 hardens (or the metal powder is sufficiently compressed), the metal mold 502 is removed and the relay plate 6 is completed as shown in FIG. 21(*c*).

Next, a fifth method for will be described while referring to FIGS. 22(*a*) to 22(*d*). The fifth method is for producing the thin relay plate 306 by cutting. First, a ceramic plate 34 or a glass plate 35 is prepared as shown in FIG. 22(*a*). Next, the reference holes 323 are opened in the plate 34 or 35 as shown in FIG. 22(*b*). Then, as shown in FIG. 22(*c*), dicing is performed on portions of the plate 34 or 35 other than those that correspond to a relay member group 307*b* shown in FIG. 22(*d*). Then, dicing is performed on the plate 34 or 35, with the reference holes 323 serving as reference points, to cut grooves 503 in the plate 34 or 35. Undiced portions 504 of the plate 34 or 35 that remain after the dicing function as the relay members 307 and the protrusions 307*a*. The diced portions, that is, the grooves 503, serve as connection portions 336 between the relay members 307.

TABLE 2

| Method | Precision |
|---|---|
| dry etching or silicon | +/− 2 microns |
| etching of stainless steel and the like | +/− 30 microns |
| electroforming | +/− 5 microns |
| powder metallurgy | +/− 20 microns |
| molding | +/− 20 microns |
| cutting | +/− 10 microns |

Table 2 shows dimensional precision achieved by various forming methods. When silicon is used as the material for both the relay plate 6 (or the relay plate 406) and the chamber plate 11, which is formed with the ink chambers 24, then the dimensional precision of the both is +/−2 microns. The relative positional shift between the ink chambers 24 and corresponding protrusion portions 7*a* can be suppressed to within +/−5 microns assuming that clearance between the second reference pin 13 and the second reference pins 13 is 3 microns.

Figure 23:
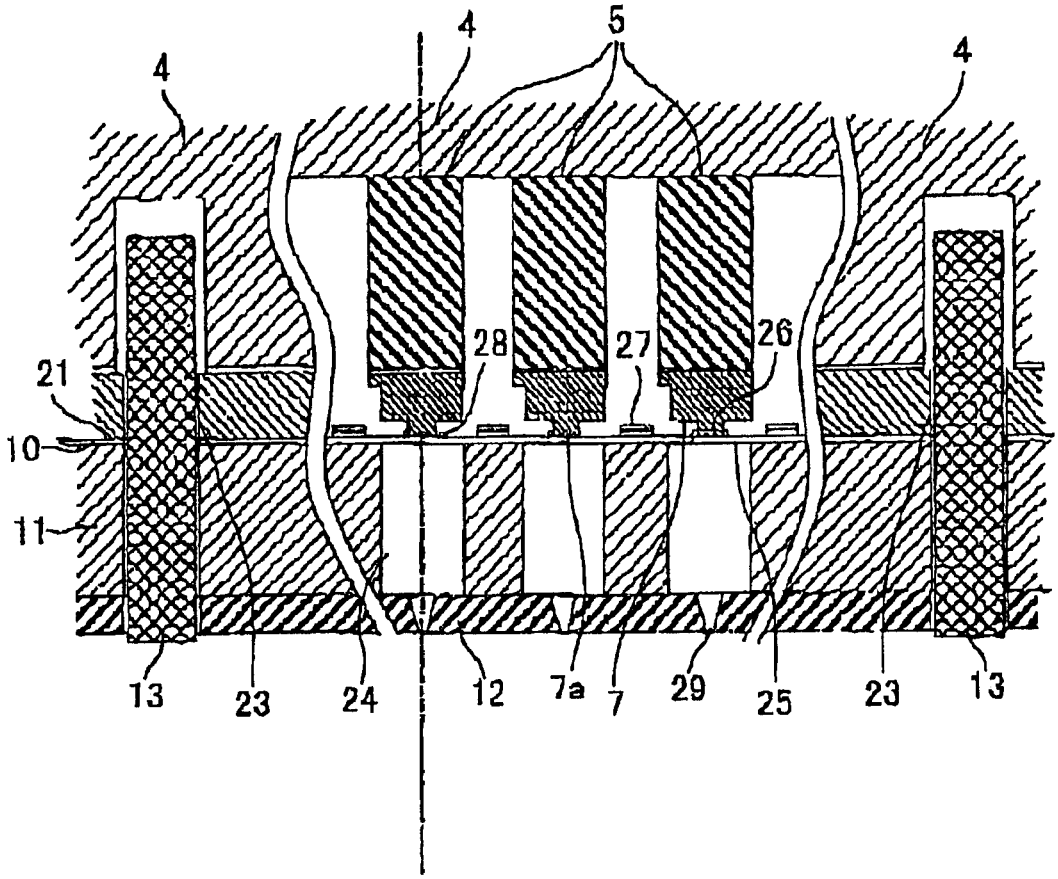
FIG. 23 is front cross-sectional view showing an ink jet head produced according to the first embodiment of the present invention.

FIG. 23 is a cross-sectional view showing an ink jet head produced using the method described in the embodiment. As indicated in single-dot chain line in FIG. 23, the protrusion portion 7*a* of each of the relay members 7 is precisely aligned with the widthwise center of the corresponding one of the ink chambers 24. In contrast, the piezoelectric actuators 5 are all slightly shifted out of alignment with the corresponding ink chambers 24. However, because the protrusion portions 7*a* all have the same dimensions and press against the diaphragm sections 25 across the same surface area and at the same position without variation, the positional shift of the piezoelectric actuators 5 does not affect the ink ejection characteristics, so ink is ejected uniformly and consistently from all of the ink chambers 24.

Figure 24:
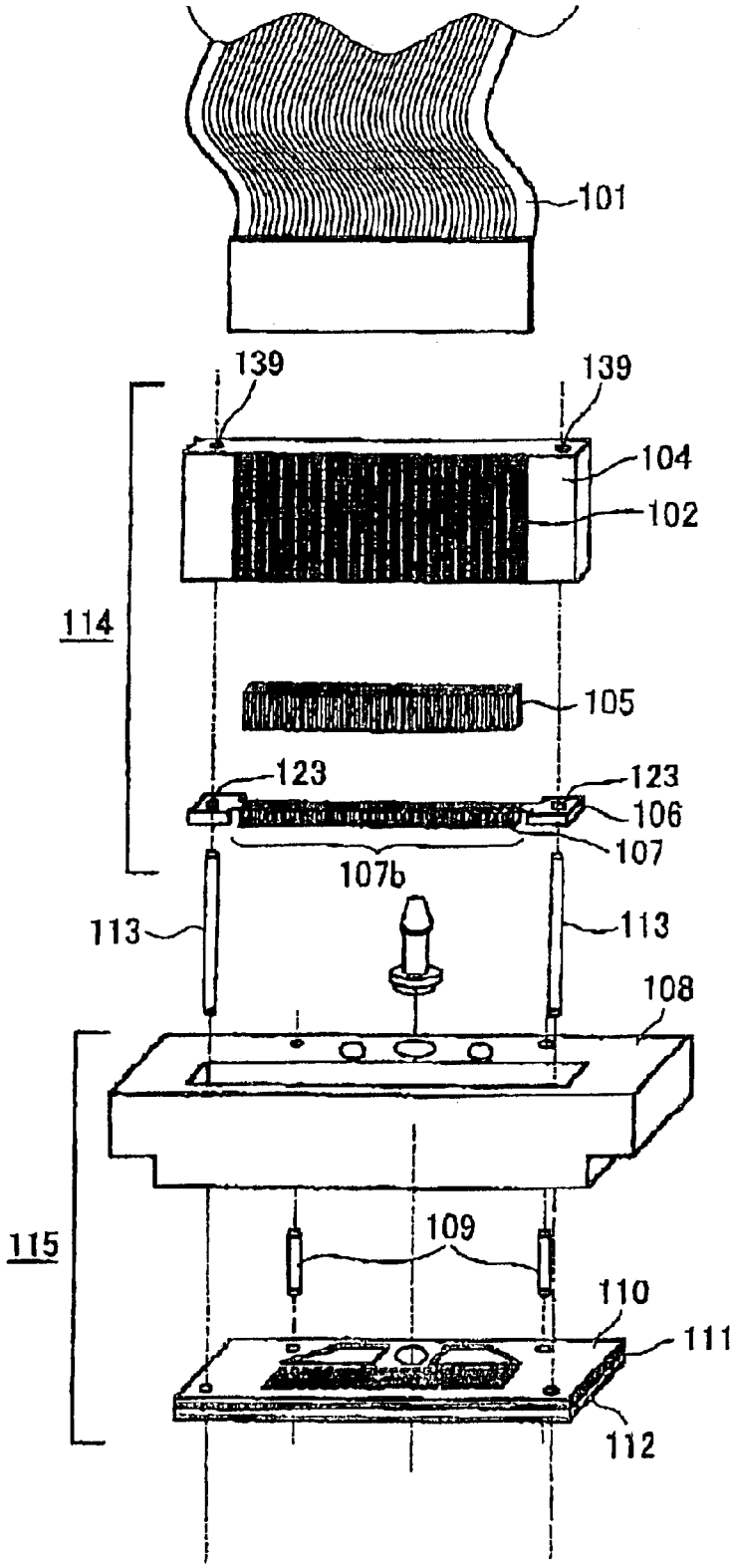
FIG. 24 is an exploded perspective view showing an ink jet head according to a second embodiment of the present invention.

Next, a method of producing an ink jet head 122 according to a second embodiment of the present invention will be described with reference to FIGS. 24 to 30. As shown in FIG. 24, the ink jet head 122 has the same basic configuration as the ink jet head 22 of the first embodiment and includes a drive portion 114 and a channel portion 115.

Figure 25:
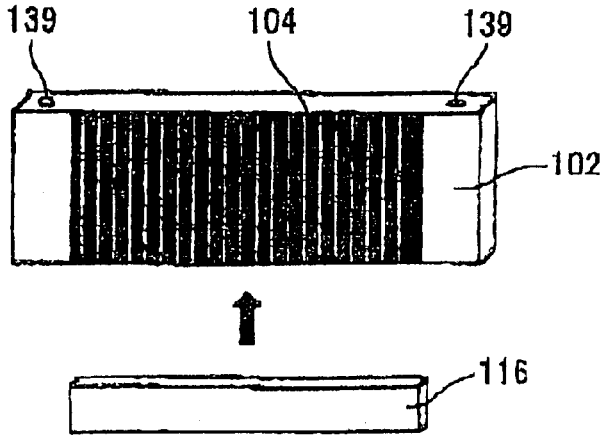
FIG. 25 is a perspective view showing a step of adhering a piezoelectric block to a support block according to a production method of the ink jet head of the second embodiment.
Figure 26:
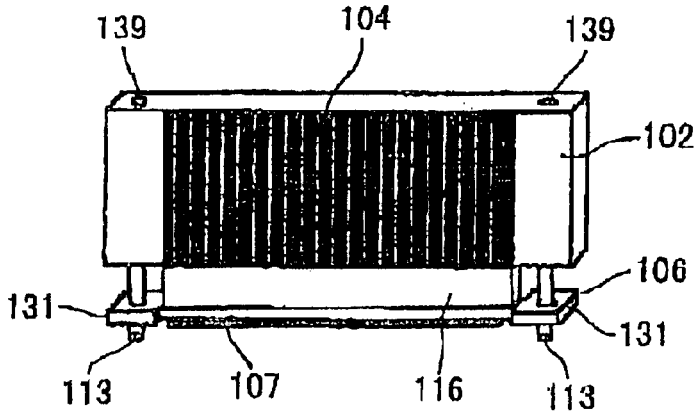
FIG. 26 is a perspective view showing a step of adhering the relay plate according to a production method of the ink jet head or the second embodiment.
Figure 27:
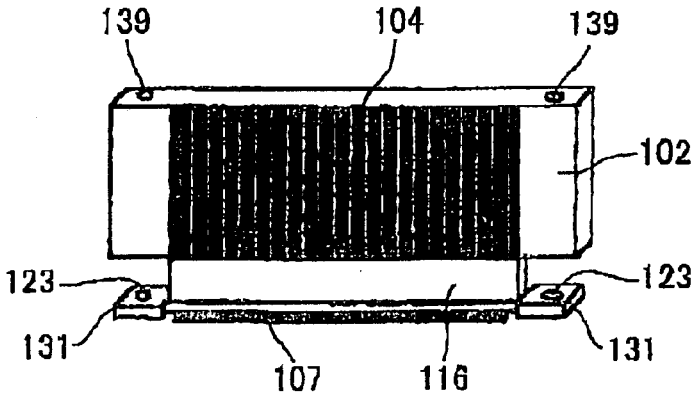
FIG. 27 is a perspective view showing a step of removing a second reference pin according to a production method of the ink jet head of the second embodiment.
Figure 28:
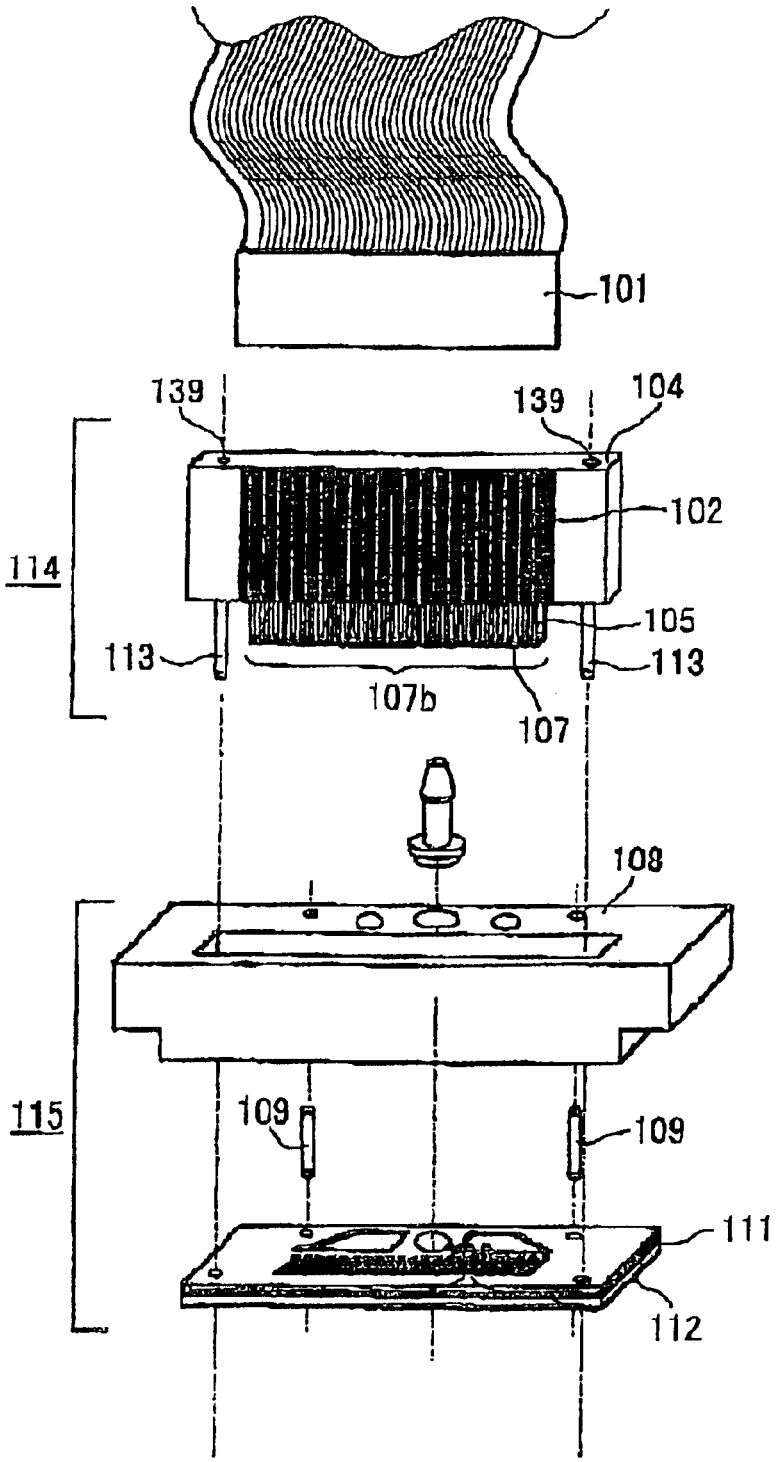
FIG. 28 is a perspective view showing a step of coupling a channel portion and a drive portion after dicing a piezoelectric block and the relay plate and removing a intermediate member according to a production method of the ink jet head of the second embodiment.

As shown in FIG. 25, first a support plate 104 is adhered to a piezoelectric block 116. Then the piezoelectric block 116 is polished to increase its surface flatness. Next, as shown in FIG. 26, a relay plate 106 is aligned using second reference pins 113 and adhered to the piezoelectric block 116. Accordingly, the relay member 107 is positioned by reference holes 123 in the relay plate 106, second reference holes 139 in the support plate 104, and the second reference pins 113. Then, the second reference pins 113 are temporarily removed as shown in FIG. 27.

Next, the piezoelectric block 116 and the relay plate 106 are simultaneously subjected to dicing to divide the piezoelectric block 116 into the piezoelectric actuators 105 and the relay members 107. The intermediate members 131 formed with the reference holes 123 are cut away using the dicer to produce the configuration shown in FIG. 28.

Figure 29:
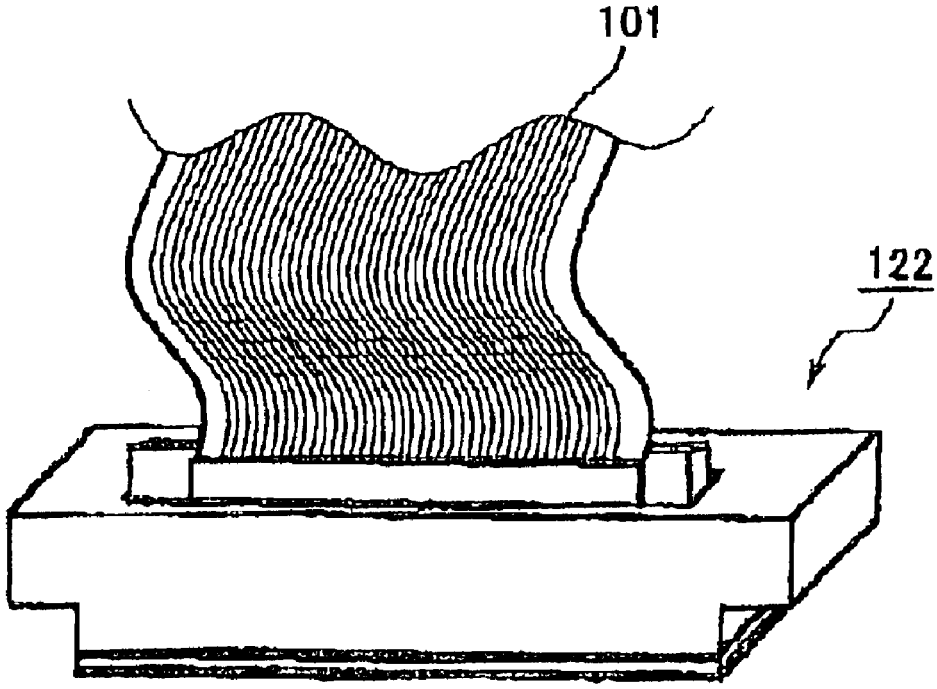
FIG. 29 is a perspective view showing an ink jet head producing using according to the second embodiment of the present invention.

Adhesive is coated on the first abutment surface 7*d* of the relay members 107 using transfer or other method and the second reference pins 113 are again inserted into the second reference holes 139. Then, the channel portion 115 and the drive portion 114 are adhered together to assemble the head. At this time, because the intermediate member 131 has already been removed when the relay member 107 is adhered to the diaphragm sections 25, only the piezoelectric actuators 105 and the relay members 107 are applied with a load in the direction from the piezoelectric actuators 105 toward the diaphragm sections 25. Therefore, a proper load can be applied to the piezoelectric actuators 105 and the relay members 107 so that the piezoelectric actuators 105 and the relay members 107 are adhered together properly. A flexible print circuit 101 is attached to complete production of the ink jet head 122. The completed ink jet head 122 is shown in FIG. 29.

Figure 30:
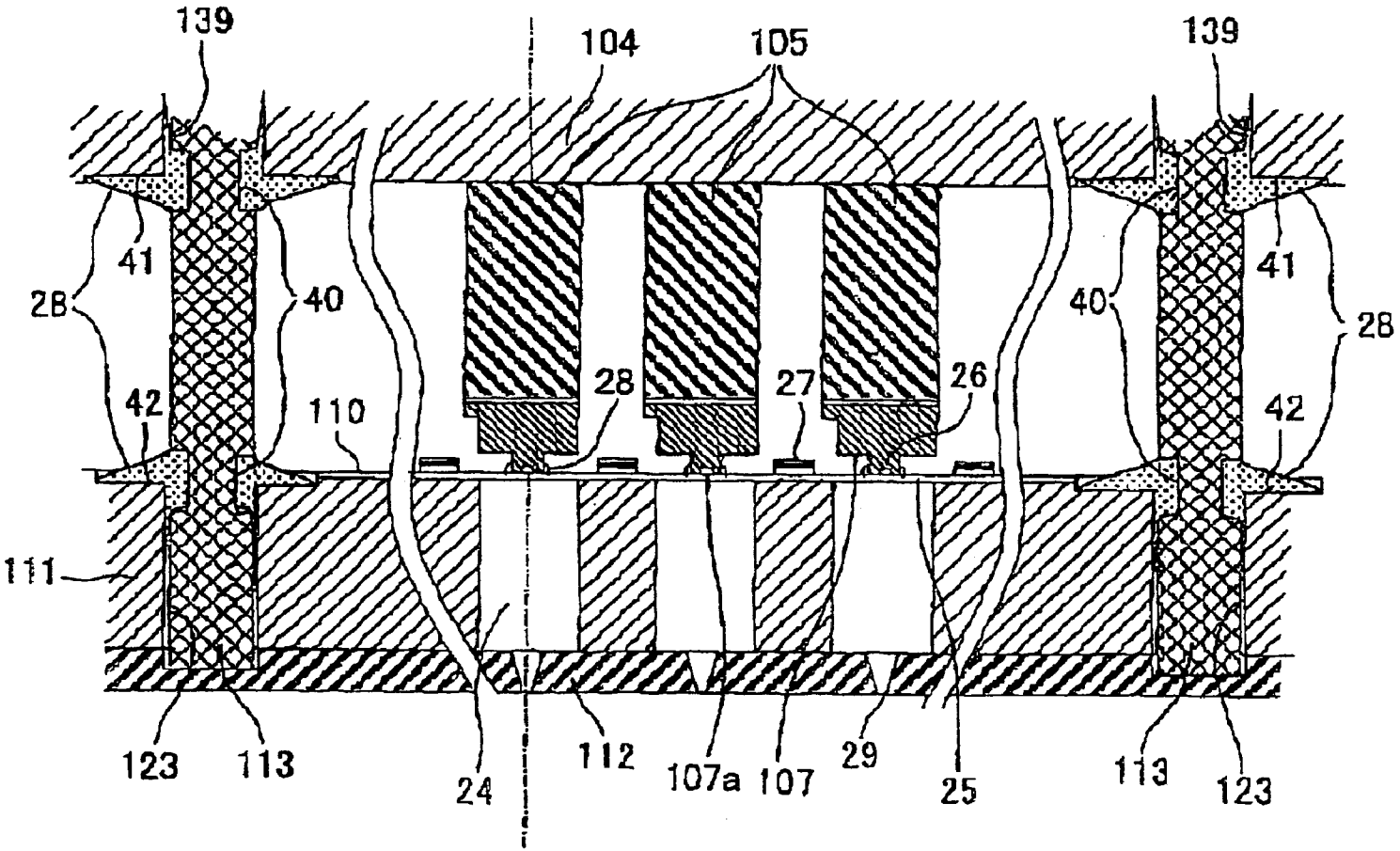
FIG. 30 is a cross-sectional view showing the ink jet head producing using according to the second embodiment of the present invention.

FIG. 30 is an enlarged cross-sectional view showing details of the ink jet head 122. Although the intermediate member 131 was cut away before the relay member 107 is adhered to the diaphragm sections 25, the second reference holes 139 and the second reference pins 113 accurately position the ink chambers 24 relative to corresponding protrusion portions 107*a* of the relay member 107.

As shown in FIG. 30, adhesive 28 adheres the support plate 104, the channel portion 115, and the drive portion 114 together. The adhesive 28 is coated on the second reference pins 113 before the second reference pins 113 are inserted into the support plate 104, the channel portion 115, and the drive portion 114. The second reference pins 113 and the support plate 104, and the channel portion 115 and the drive portion 114, are fixed together by the adhesive 28 when the adhesive 28 cures and hardens. Slight indentations 41 for coating with the adhesive 28 are formed in the portions of the support plate 104 through which the second reference pins 113 penetrate. Similarly, slight indentations 42 are formed in portions of a diaphragm plate 110 and a chamber plate 111 through which the second reference pins 113 penetrate. Further, notches 40 are formed in portions of the second reference pins 113 that are adjacent to the indentations 41, 42.

The notches 40 and the indentations 41, 42 increase the surface area where the adhesive 28 clings, so that adhering strength is improved. If the adhesive 28 flows out onto the piezoelectric actuators 105, then this can reduce the ink ejection performance and adversely affect the ejection consistency. However, the notches 40 and the indentations 41, 42 prevent the adhesive 28 from flowing onto the piezoelectric actuators 105.

The intermediate member 131 of the relay plate 106 is removed when machining the piezoelectric block 116 to form the piezoelectric actuators 105. Therefore, the reference holes 123 that are formed in the intermediate member 131 are not available for positioning the relay member 107 on the diaphragm sections 25. However, the second reference holes 139 that are formed in the support plate 104 serve to position the relay member 107 on the diaphragm sections 25. Accordingly, when the relay member 107 is adhered to the diaphragm sections 25, only the piezoelectric actuators 105 and the relay members 107 are applied with a load in the direction from the piezoelectric actuators 105 toward the diaphragm sections 25. Therefore, a proper load can be applied to the piezoelectric actuators 105 and the relay members 107 so that the piezoelectric actuators 105 and the relay members 107 are adhered together properly. That is, the potential problem of adhesion being insufficient because load is also applied to the intermediate member 131 will not occur. Also, the ink chambers 24 and the protrusion portions 107*a* will be positioned accurately with respect to each other by the second reference holes 139.

Next, a method of producing an ink jet head according to a third embodiment of the present invention will be described with reference to FIGS. 31 to 40.

Figure 31:
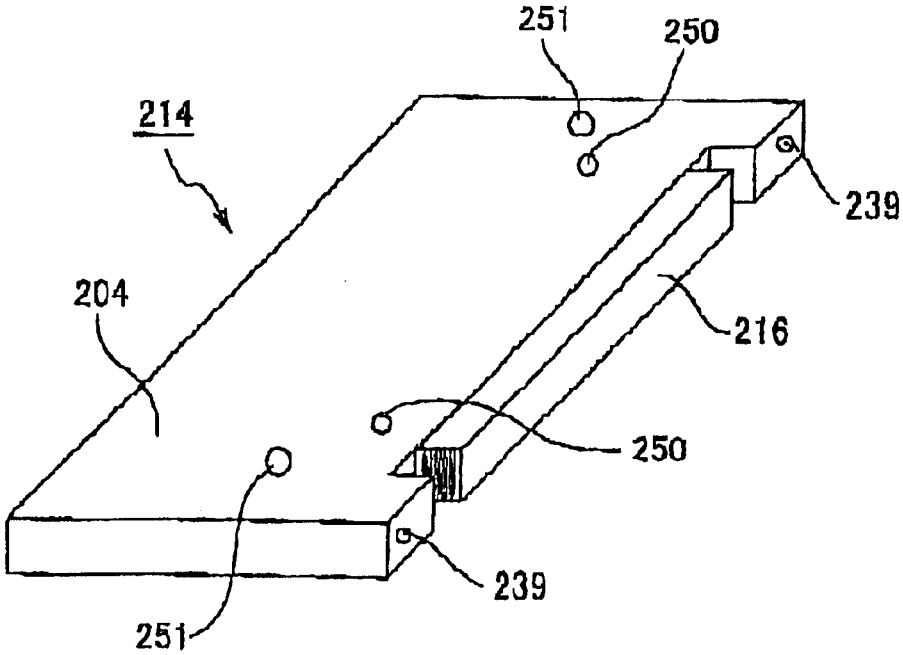
FIG. 31 is a perspective view showing a step of adhering a piezoelectric block to a support block according to a production method of the ink jet head of a third embodiment of the present invention.

First, a piezoelectric block 216 is adhered to one end of a support plate 204 as shown in FIG. 31. As explained in the first embodiment, there arm $d_{33}$ type and $d_{31}$ type piezoelectric blocks. The piezoelectric block 216 according to the third embodiment is a $d_{33}$ type. If a $d_{31}$ type were used, then the piezoelectric actuator would be adhered to the upper surface (as viewed in FIG. 31) of the support plate 204, that is, on the surface of the support plate 204 that extends substantially perpendicular to the surface on which the piezoelectric block 216 is adhered in this embodiment.

Figure 32:
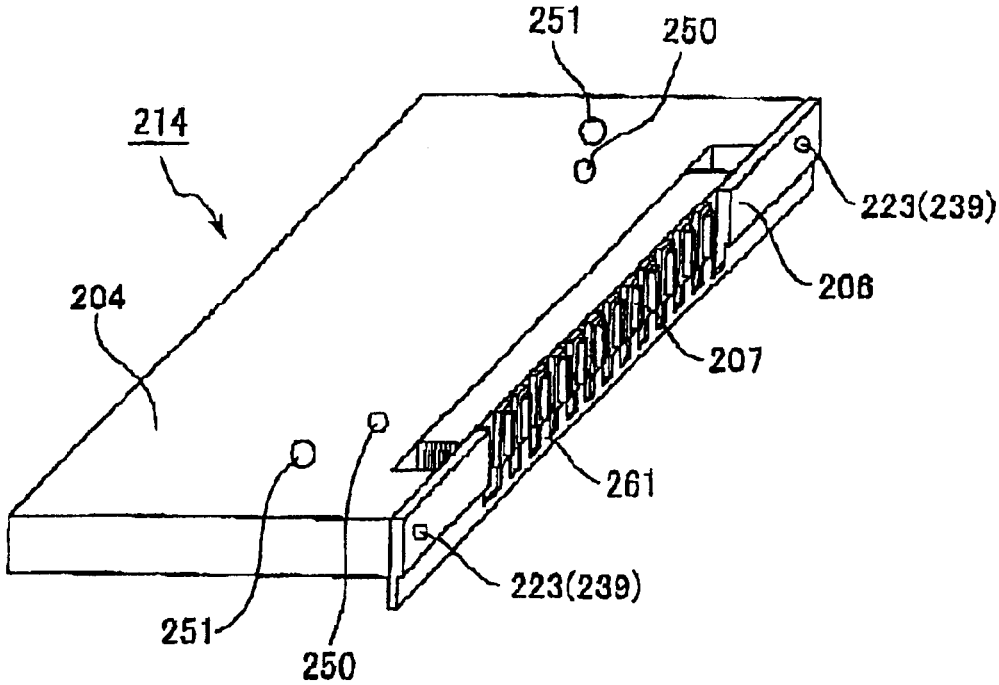
FIG. 32 is a perspective view showing a step of adhering a relay plate according to the production method of the ink jet head of the third embodiment of the present invention.
Figure 33A:
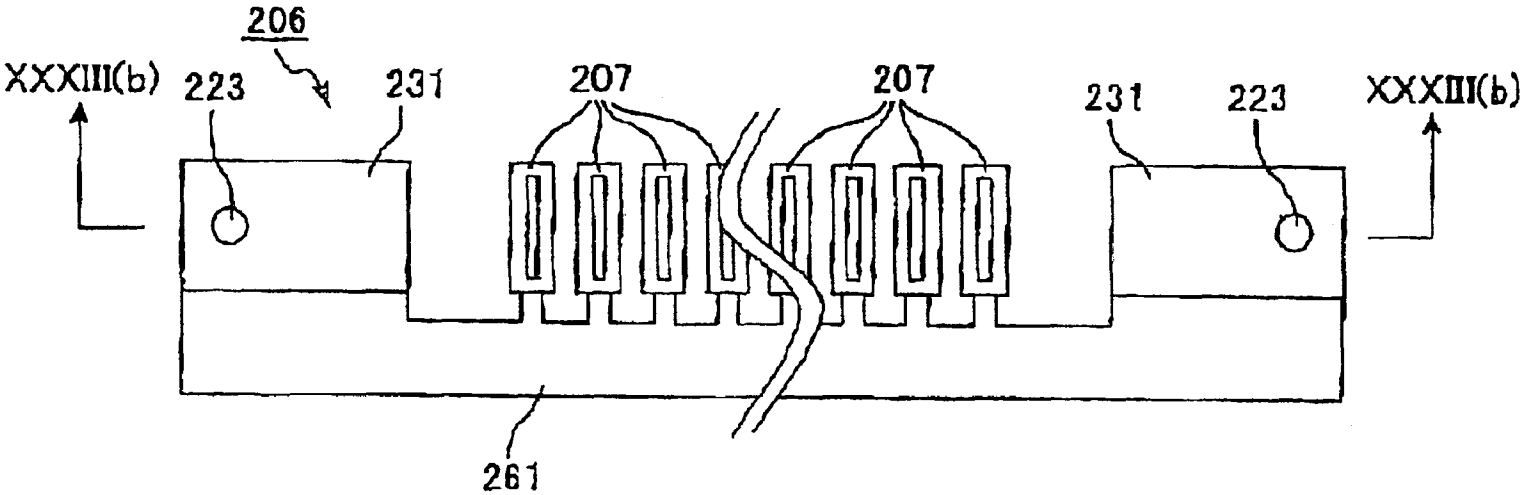
FIG. 33(*a*) is a plan view showing a relay plate according to a third embodiment of the present invention.
Figure 33B:
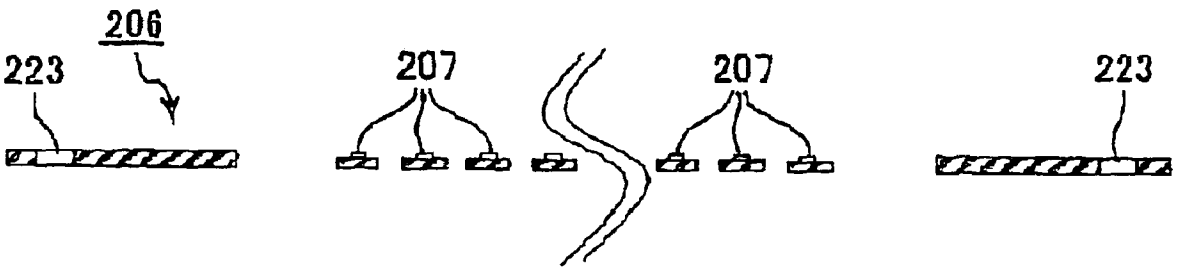

Next, an shown in FIG. 32, a relay plate 206 is adhered to the previously adhered support plate 204 and the piezoelectric block 216. An explanation will be provided for the relay plate 206. As shown in FIGS. 33(*a*) and 33(*b*), the relay plate 206 includes a plurality of relay members 207, an intermediate member 231, and a connection portion 261, all formed integrally together. The intermediate member 231 is formed with reference holes 223. Because the relay members 207, the intermediate member 231, and the connection portion 261 are all formed integrally together, the distances are accurately set from each of the reference holes 223 to each of the relay members 207. Because the relay plate 206 of the third embodiment is formed from silicon, the positional precision of the relay members 207 is +/−2 microns. It should be noted that the relay members 207 are narrower than the piezoelectric actuators 205 in the nozzle alignment direction. This prevents the relay members 207 from being peeled off when dicing the piezoelectric block 216 to form the piezoelectric actuators 205.

As shown in FIG. 32, the reference holes 223 of the relay plate 206 are aligned with the second reference holes 239 of the support plate 204 and, in this condition, the relay plate 206 is adhered to the already adhered support plate 204 and piezoelectric block 216 to produce the drive portion 214. The relay members 207 are adhered to the end surface of the piezoelectric block 216. Also, the connection portion 261 is aligned parallel with the lengthwise dimension of the piezoelectric block 216, but not adhered to the either the support plate 204 or the piezoelectric block 216.

Figure 34:
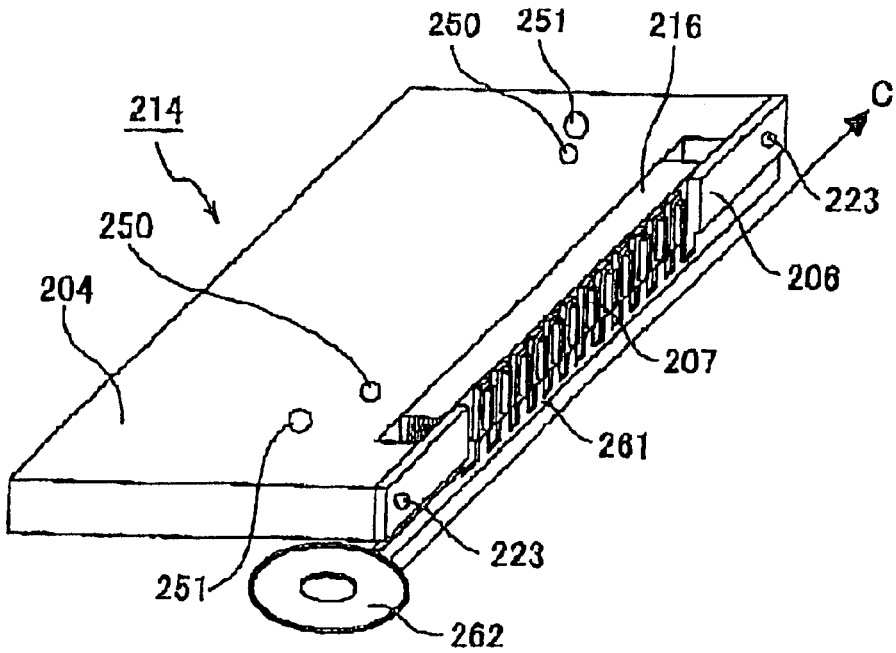
FIG. 34 is a perspective view showing a step of cutting away a connection portion of the relay plate according to the production method of the ink jet head of the third embodiment of the present invention.

Next, the connection portion 261 is cut away from the rest of the relay plate 206 by dicing using a dicing blade 262 in a direction parallel to the nozzle alignment direction as indicated by an arrow C in FIG. 34. During this process, only the silicon material of the relay plate 206 is cut. Therefore, the dicing blade 262 according to the present embodiment has a size of grains #2000 as per Japanese Industrial Standard (JIS) R 6001 in order to prevent silicon chipping. By selecting the dicing blade 262 that is most suitable for the material or the relay plate 206, the relay plate 206 can be cut at a feed speed of about 2 cm/minute.

Figure 35:
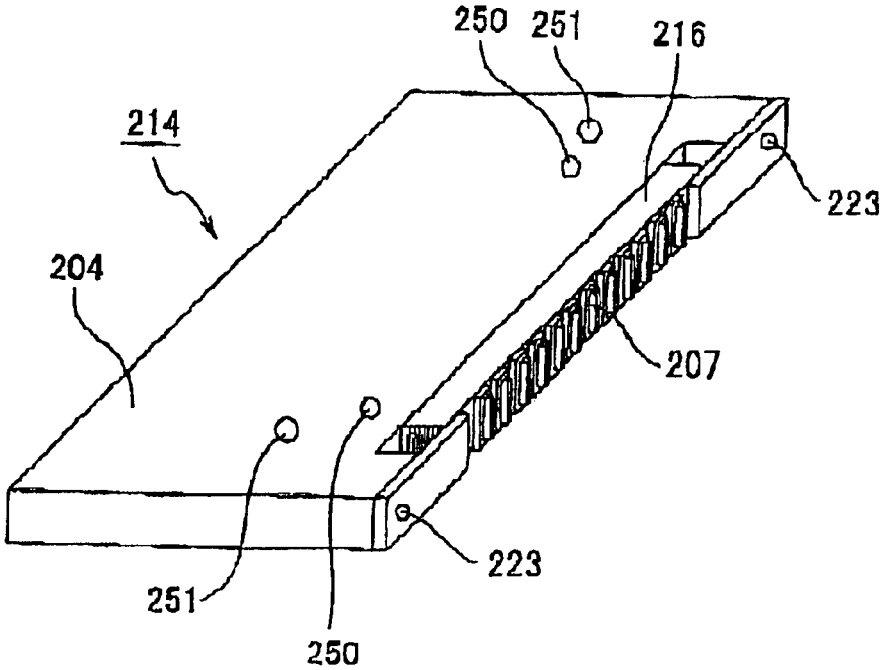
FIG. 35 is a perspective view showing a drive portion with the connection portion removed.

FIG. 35 shows a drive portion 214 after the connection portion 261 is cut away. Although the piezoelectric block 216 is not yet divided into the individual piezoelectric actuators 205 at this time, the relay members 207 are already separate from each other. Also, the distance from each of the relay members 207 to each of the reference holes 223 and also the distance between adjacent relay members 207 are accurately set.

Figure 36:
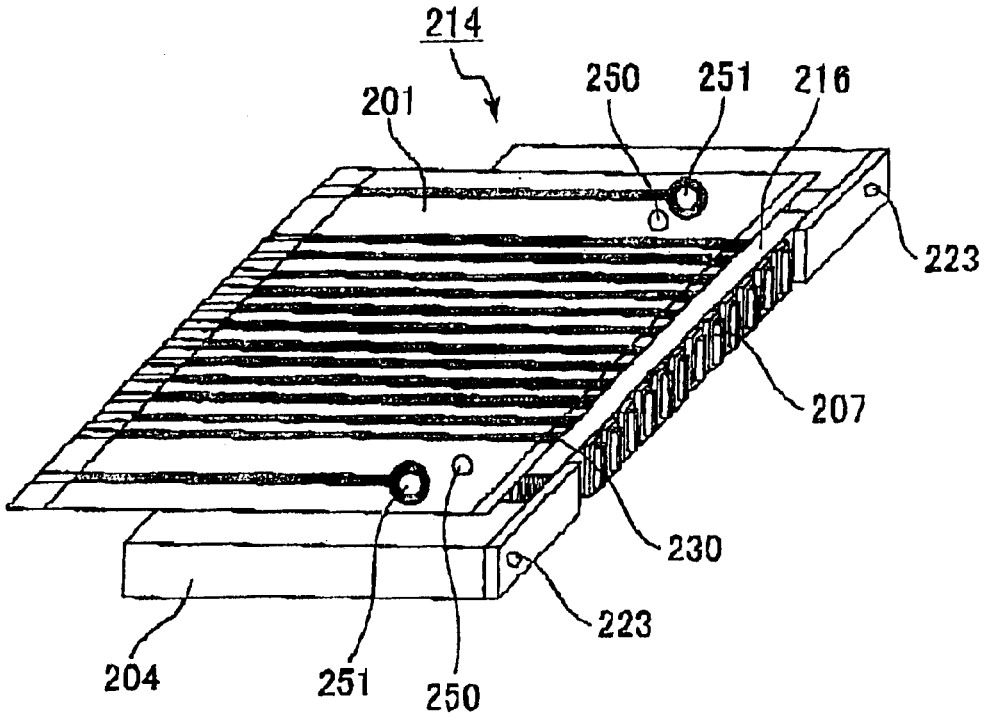
FIG. 36 is a perspective view showing a step of adhering an FPC to the support block according to the production method of the ink jet head of the third embodiment of the present invention.

As shown in FIG. 36, a flexible print circuit 201 is adhered to the upper surface of the support plate 204. When adhering the flexible print circuit 201 to the support plate 204, positioning holes 250 formed in the support plate 204 and the flexible print circuit 201 are used to position the flexible print circuit 201 and the support plate 204 with respect to each other.

Figure 37:
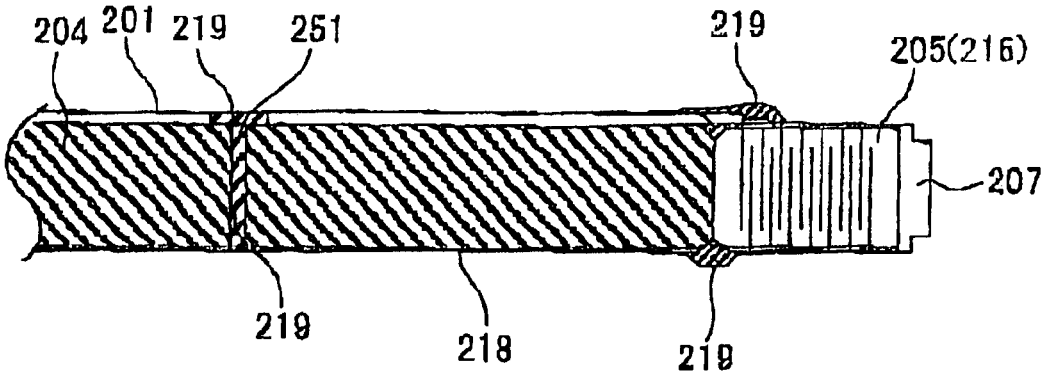
FIG. 37 is a magnified cross-sectional view showing a step of coating a conductive paste where various electrodes are adhered to the piezoelectric block and connecting a common electrode according to the production method of the ink jet head of the third embodiment of the present invention.
Figure 38:
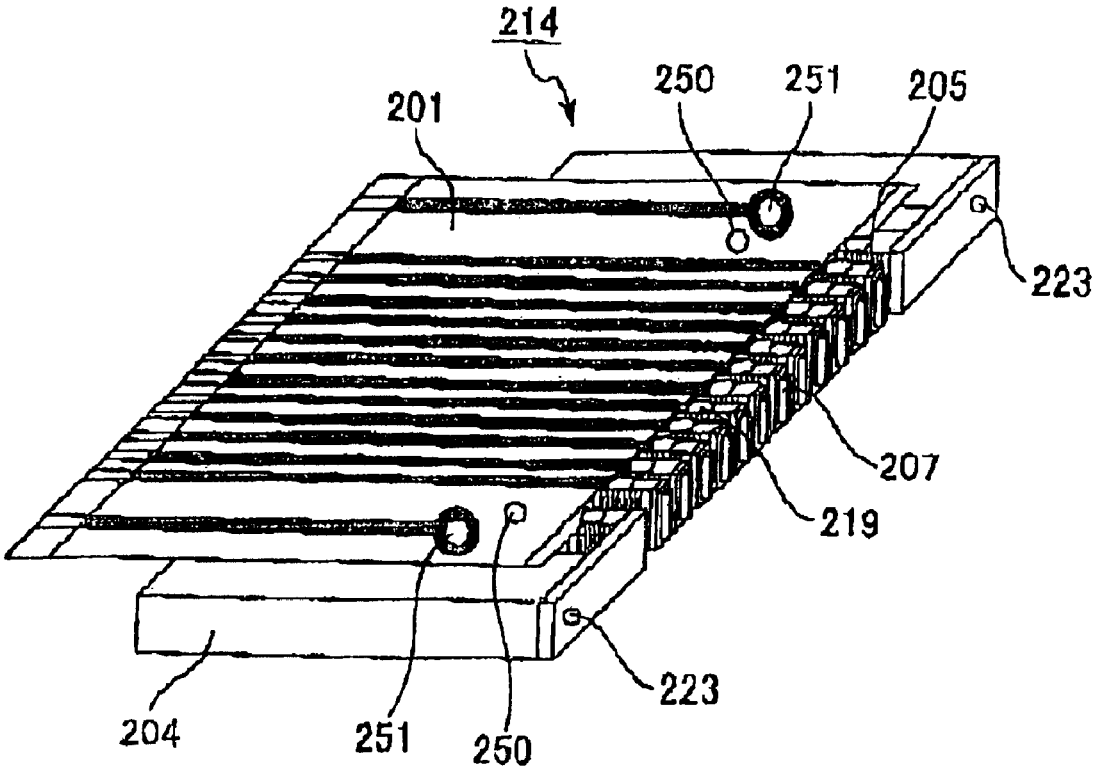
FIG. 38 is a perspective view showing a step of dividing the piezoelectric block into individual piezoelectric actuators according to the production method of the ink jet head of the third embodiment of the present invention.

As shown in FIGS. 37 and 38, conductive paste 219 is coated where the electrodes 230 are adhered to the piezoelectric block 216. Also, a common electrode 218 is connected to each of the electrodes 230 by way of via holes 251 that penetrate through the support plate 204. The conductive paste 219 is also coated where the common electrode 218 and the piezoelectric block 216 are adhered together.

As shown in FIG. 38, grooves are formed in between the relay members 207 at a predetermined pitch to divide the piezoelectric block 216 into the individual piezoelectric actuators 205. The piezoelectric actuators 205 correspond to the individual ink chambers (not shown in FIG. 38). This completes the drive portion 214.

Figure 39:
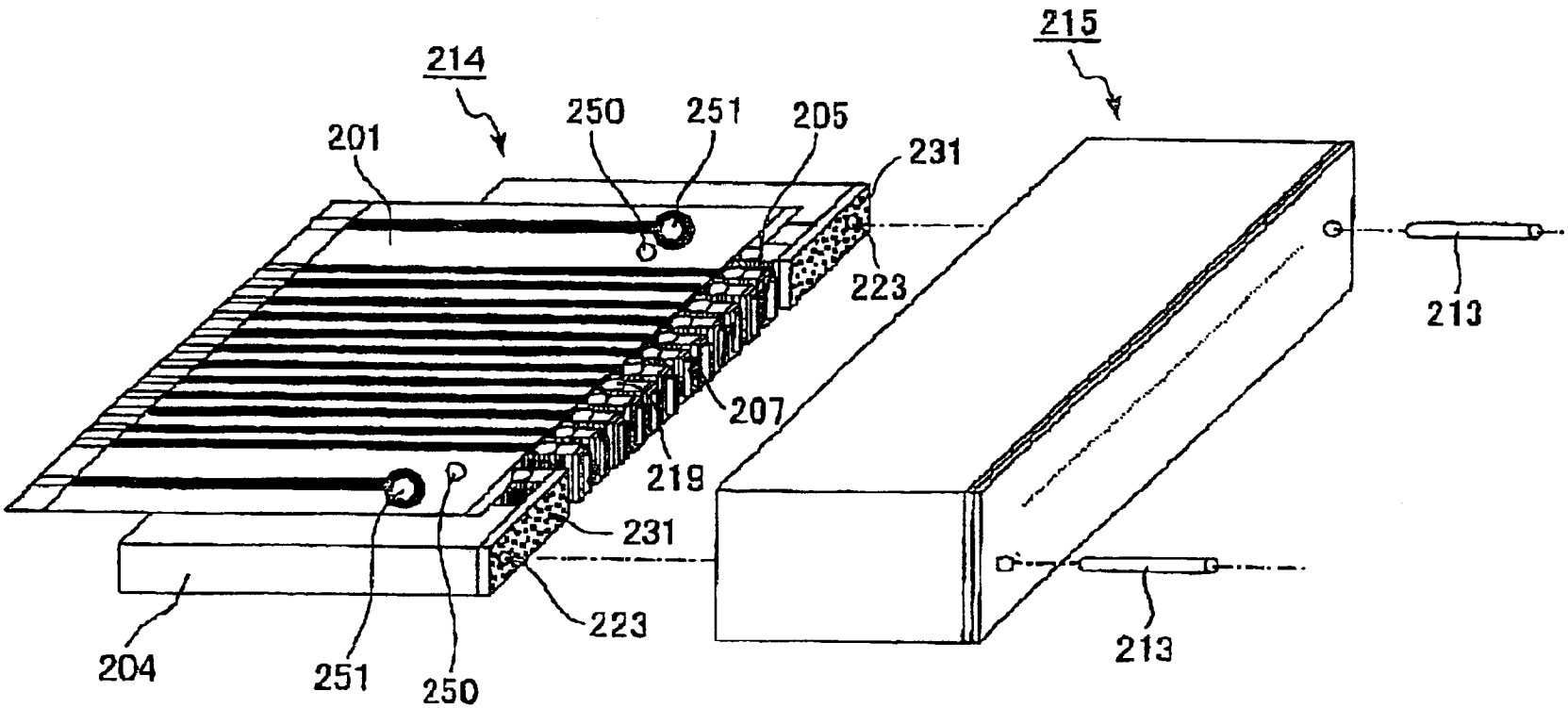
FIG. 39 is a perspective view showing a step of adhering the channel block and a drive portion according to the production method of the ink jet head of the third embodiment of the present invention.
Figure 40:
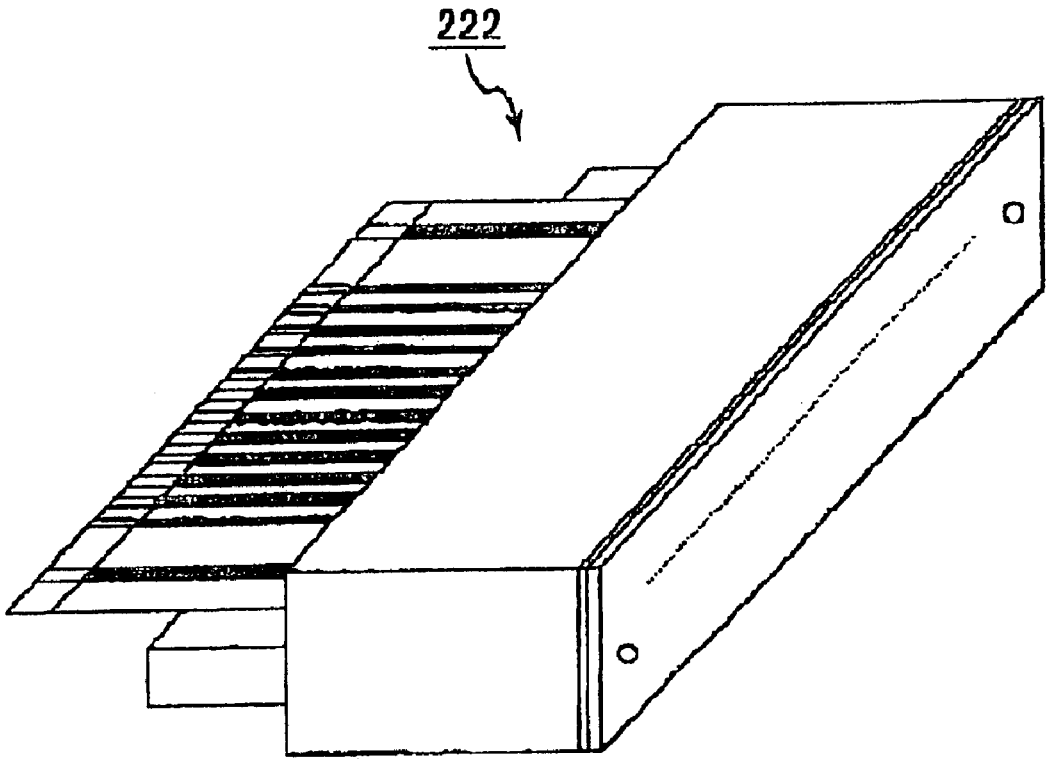
FIG. 40 is a perspective view showing an ink jet head produced according to the third embodiment of the present invention.

Lastly, as shown in FIG. 39, adhesive is coated to the end of the completed drive portion 214. Then, positioning pins 213 and reference holes 223 are used to position the drive portion 214 with respect to the channel portion 215. Then, once aligned, the drive portion 214 and the channel portion 215 are adhered together. The completed ink jet head 222 appears as shown in FIG. 40.

It should be noted that silicon and zirconia are appropriate materials for making the intermediate members 207 because these materials can be machined with great precision. On the other hand, metals with a high specific gravity are suitable as the material for the support plate 204. In particular, damping materials such as SUS 430 are ideal materials because they absorb vibration of the piezoelectric actuators 205 and suppress cross talk. However, it is extremely difficult to divide the drive portion 214 into parts corresponding to the ink chambers when the piezoelectric block 216 and the relay member 207 of the drive portion 207 are made from different materials.

The reason for this is that the machining conditions and blade specifications used during dicing are completely different when machining a very hard material such as zirconia and a soft metal such as SUS 430. That is, when the material to be machined is extremely hard, then a blade with a small or fine size of grains is required to prevent chipping. However, when machining a soft material such as a metal, then a blade with a larger size of grains is required to prevent the blade from clogging up. Therefore, when two different types of material need to be cut, the dicing process needs to be divided up into several different steps while changing the blade and machining conditions. This reduces machining efficiency. It is conceivable to use a wire saw to form the grooves, but this type of machining is expensive. Additionally, because this type of machining requires a special grinding powder, the piezoelectric actuators 205 can be contaminated with the powder, resulting in defects.

However, there is no need to cut the relay member 207, the piezoelectric actuators 205, and the support plate 204 simultaneously when using the method of producing the ink jet head according to the present embodiment. Therefore, a dicing blade can be used that is suitable for cutting the piezoelectric actuators 205. Accordingly, there will be no problems of chipping or clogging when cutting the piezoelectric actuators 205, so that work can be performed efficiently.

The ink jet head according to the present invention uses the following configuration to change pressure in ink chambers with one surface formed by a diaphragm. Elongated relay members are fixed on the diaphragm, in between the diaphragm and piezoelectric actuators. Each relay member is positioned at the imaginary central line of the corresponding ink chamber and contact the diaphragm with a smaller surface area than the region where the corresponding ink chamber confronts the diaphragm.

This configuration provides the following effects. The relay members are configured independently from the ink chamber defining members. Therefore, regardless of the thermal expansion coefficient of the ink chamber defining members, the relay members can be properly aligned on the imaginary central lines of the ink chambers. The relay members are independent from the diaphragm and so can be fixed to the diaphragm after the diaphragm is adhered to form the ink chambers. Therefore, any of a variety of adhesives can be used to adhere the diaphragm to the ink chamber forming member. Also, a great range of inks can be used in the ink jet head and the ink jet head can be used at a greater range or ambient temperatures.

In an ink jet head according to the present invention, all the relay members apply pressure to the diaphragm at a fixed predetermined position and across the same surface area. Therefore, high quality printing can be achieved. Also, a great range of inks can be used in the ink jet head, and the ink let head can be used at a greater range of ambient temperatures. Accordingly, an ink jet printer including the ink jet head according to the present invention is applicable to various uses.

While the invention has been described in detail with reference to the specific embodiments thereof, it would be apparent to those skilled in the art that various changes and modifications may be made therein without departing from the spirit of the invention.

For example, the embodiments describe using type $d_{33}$ piezoelectric blocks, which generate displacement that is parallel with an applied electric field, as the piezoelectric blocks 16, 116, and 216. However, a $d_{31}$ type, which generates displacement that is perpendicular to the applied electric field, could be used as the piezoelectric blocks instead. Also, the flexible print circuit 201 is used to apply electric signals to the piezoelectric actuators 205. However, the support plate 204 could be formed from or with an insulating member and an electrode pattern can be formed directly on the insulating member instead.

What is claimed is:

1. An ink jet head comprising:

a channel member formed with a plurality of nozzles, a plurality of ink chambers, and an ink channel, the nozzles being aligned in a nozzle alignment direction, the ink chambers each having a width extending in the nozzle alignment direction, the nozzles and the ink chambers being provided in a one-to-one correspondence, each ink chamber being in fluid communication with a corresponding one of the nozzles and the ink channel, the ink channel supplying ink to fill the ink chambers;

a diaphragm defining one portion of each of the ink chambers;

a plurality of piezoelectric actuators in confrontation with the diaphragm in a one-to-one correspondence with the ink chambers;

a drive unit that deforms the piezoelectric actuator to deform the diaphragm and change the pressure inside the ink chamber to eject ink from the ink chamber through the nozzle; and a plurality of relay members in a one-to-one correspondence with the ink chambers and the piezoelectric actuators, each relay member having a first abutment surface and a second abutment surface on opposite sides thereof, each first abutment surface abutting the diaphragm across a width that extends in the nozzle alignment direction, the width of each first abutment surface being shorter than the width of the corresponding ink chamber, each second abutment surface being coupled to the corresponding piezoelectric actuator and having a width that extends in the nozzle alignment direction, the width of each second abutment surface being equal to or shorter than the width of the corresponding piezoelectric actuator, the width of each first abutment surface being shorter than the width of each second abutment surface.

2. The ink jet head as claimed in claim 1, wherein the first abutment surface of each relay member abuts the diaphragm at a position substantially central in the corresponding ink chamber with respect to the nozzle alignment direction.

3. The ink jet head as claimed in claim 1, further comprising:

a support member, the piezoelectric actuators being fixed to the support member, the relay members having a thickness in a thickness direction that extends from the support member to the channel member; and an intermediate member interposed between the support member and the diaphragm, the intermediate member having a thickness in the thickness direction that is the equal to or less than the thickness of the relay members.

4. The ink jet head as claimed in claim 3, wherein the intermediate member is firmed with a positioning hole for positioning the relay members with respect to the ink chambers.

5. The ink jet head as claimed in claim 1, further comprising a support member, the piezoelectric actuators being fixed to the support member, the support member being formed with a positioning hole for positioning the relay members with respect to the ink chamber.

6. The ink jet head as claimed in claim 1, wherein the first abutment surface of each relay member in adhered to the diaphragm by adhesive, the first abutment surface of each relay member being formed with at least one of a hole and/or a groove for preventing the adhesive from flowing onto the diaphragm.

7. The ink jet head as claimed in 1, wherein the relay members are made from a material selected from the group consisting of silicon, stainless steel, a highly rigid resin, ceramic, and glass.

8. The ink jet head as claimed in claim 1, wherein the relay members are formed by electroforming using a material selected from the group consisting of iron (Fe), nickel (Ni), chrome (Cr), zinc (Zn), tin (Sn), indium (In), gold (Au), silver (Ag), copper (Cu), platinum (Pt), palladium (Pd), iridium (Ir), and an alloy, the alloy including at least one of iron (Fe), nickel (Ni), chrome (Cr), zinc (Zn), tin (Sn), indium (In), gold (Au), silver (Ag), copper (Cu), platinum (Pt), palladium (Pd), and iridium (Ir).

9. The ink jet head as claimed in claim 8, wherein the relay members further include at least one material selected from the group consisting of sulfur (S), carbon (C), phosphorus (P), and boron (B).

10. The ink jet head as claimed in claim 1, further comprising a reinforcement plate abutting the diaphragm at positions not in confrontation with the ink chambers.

11. A method of producing an ink jet head including:

a channel member formed with ink chambers;

a diaphragm forming at least a portion of each ink chamber; and a plurality of piezoelectric actuators each generating displacement, the method comprising:

preparing a relay plate having:

a relay member group including a plurality of relay members and connection portions, the connection portions being disposed between and connecting adjacent relay members; and a positioning portion for positioning the relay members into alignment with the ink chambers;

adhering the relay member group onto a piezoelectric block;

cutting the relay plate and the piezoelectric block to produce piezoelectric actuators and relay members in a one-to-one correspondence with the ink chambers, each relay member having one end attached to a corresponding one of the piezoelectric actuators and another end being free;

after the process of cutting, aligning the relay members with the ink chambers using the positioning portion; and adhering the free ends of the relay members onto the diaphragm at positions corresponding to the ink chambers.

12. The method as claimed in claim 11, wherein the process of preparing the relay plate includes at least one of a process of etching and a process of etching and cutting.

13. The method as claimed in claim 11, wherein the process of preparing the relay plate includes at least one of a process of powder metallurgy and a process of powder metallurgy and cutting.

14. The method as claim in claim 11, wherein the process of preparing the relay plate includes at least one of a process of electroforming and a process of electroforming and cutting.

15. The method as claimed in claim 11, wherein the process of preparing the relay plate includes at least one of a process of molding and a process of molding and cutting.

16. The method as claimed in claim 11, wherein the process of preparing the relay plate includes:

preparing a plate having a flat surface, the plate being made from a material to be used as the relay plate; and forming grooves in the plate at positions corresponding to positions between the piezoelectric actuators to produce the relay member group, wherein the connection portions are configured by portions of the plate that correspond to the grooves and the relay members are configured from portions of the plate that correspond to in between adjacent grooves.

17. The method as claimed in claim 11, wherein the process of preparing the relay plate includes forming the positioning portion with a hole.

18. The method as claimed in claim 17, wherein the process of preparing the relay plate includes forming the relay members and the hole by etching using the same mask.

19. The method as claimed in claim 17, wherein the relay plate includes a first surface and a second surface on opposite sides thereof, the process of forming the hole including:

forming a first hole to a predetermined depth in the first surface of the relay plate, the first hole being formed to a diameter; and after forming the first hole, forming a second hole in the second surface at a position that corresponds to the first hole through the relay plate to the first hole, the second hole being formed to a greater diameter than the first hole.

20. The method as claimed in claim 19, wherein the process of forming the second hole includes over-etching when forming the second hole through to the first hole.

21. The method as claimed in claim 20, wherein the process of over-etching includes forming an etching prevention layer on the first surface.

22. A method for producing an ink jet head including:

a channel member formed with ink chambers;

a diaphragm forming at least a portion of each ink chamber; and a plurality of piezoelectric actuators each generating displacement, the method comprising:

fixing a piezoelectric block onto a support member;

preparing a relay plate including:

a plurality of relay members aligned in an alignment direction;

a positioning portion for positioning the relay members into alignment with the ink chambers; and a connection portion that connects the plurality of relay members to the positioning portion;

adhering the relay plate to the piezoelectric block;

cutting the connection portion in a direction parallel to the alignment direction of the relay members to divide the relay plate into the positioning portion and the relay members;

dividing the piezoelectric block in a one-to-one correspondence with the ink chambers to form the piezoelectric actuators to produce a drive portion;

preparing a channel member including the ink chambers; and coupling the drive portion to the channel member.

23. The method as claimed in claim 22, wherein the process of preparing the relay plate includes at least one of a process of etching and a process of etching and cutting.

24. The method as claimed in claim 22, wherein the process of preparing the relay plate includes at least one of a process of powder metallurgy and a process of powder metallurgy and cutting.

25. The method as claim in claim 22, wherein the process of preparing the relay plate includes at least one of a process of electroforming and a process of electroforming and cutting.

26. The method as claimed in claim 22, wherein the process of preparing the relay plate includes at least one of a process of molding and a process of molding and cutting.

27. The method as claimed in claim 22, wherein the process of preparing the relay plate includes forming the positioning portion with a hole.

28. The method as claimed in claim 27, wherein the process of preparing the relay plate includes forming the relay members and the hole by etching using the same mask.

29. The method an claimed in claim 27, wherein the relay plate includes a first surface and a second surface on opposite sides thereof, the process of forming the hole including:

forming a first hole to a predetermined depth in the first surface of the relay plate, the first hole being formed to a diameter; and after forming the first hole, forming a second hole in the second surface at a position that corresponds to the first hole through the relay plate to the first hole, the second hole being formed to a greater diameter than the first hole.

30. The method as claimed in claim 29, wherein the process of forming the second hole includes over-etching when forming the second hole through to the first hole.

31. The method as claimed in claim 30, wherein the process of over-etching includes forming an etching prevention layer on the first surface.

32. A method of producing an ink jet head, the method comprising:

preparing a support member including with two positioning holes;

fixing a piezoelectric block onto the support member;

preparing a relay plate including:

a plurality of relay members aligned in an alignment direction;

a positioning portion for positioning the relay member group with respect to the ink chambers, the positing portion including two positioning holes at positions corresponding to the positioning holes of the support member; and a connection portion that connects the plurality of relay members to the positioning portion;

preparing two positioning members;

inserting the two positioning members into the two positioning holes of the support members and into the two positioning holes of the positioning portion to position the relay plate with respect to the support member;

fixing the relay plate onto the piezoelectric block;

cutting the relay plate and the piezoelectric block into a one-to-one correspondence with the ink chambers;

cutting away the positioning portion to produce a drive portion;

preparing a channel member with the ink chambers; and coupling the drive portion onto the channel member.

33. The method as claimed in claim 32, wherein:

the process of preparing the relay plate includes forming each of the relay members with an adhesion surface for connecting with the diaphragm, the adhesion surfaces each including at least one of notches and indentations; and the process of coupling the drive portion onto the channel member includes coating adhesive onto the adhesion surfaces to adhere the relay members to the diaphragms, the at least one of the notches and the indentations increasing adhesive strength and preventing the adhesive from flowing onto the diaphragm.

34. The method as claimed in claim 32, wherein:

the process of preparing the support member includes forming the support member with an adhesion surface for connecting with the positioning members, the adhesion surfaces each including at least one of notches and indentations;

the process of preparing the two positioning members includes forming each of the positioning members with an adhesion surface for connecting with the support member and the channel member, the adhesion surfaces each including at least one of notches and indentations; and the process of preparing the channel members includes forming the channel member with an adhesion surface for connecting with the positioning members, the adhesion surfaces each including at least one of notches and indentations.

35. An ink jet printer comprising an ink jet head, wherein the ink jet head includes:

a channel member formed with a plurality of nozzles, a plurality of ink chambers, and an ink channel, the nozzles being aligned in a nozzle alignment direction, the ink chambers each having a width extending in the nozzle alignment direction, the nozzles and the ink chambers being provided in a one-to-one correspondence, each ink chamber being in fluid communication with a corresponding one of the nozzles and the ink channel, the ink channel supplying ink to fill the ink chambers;

a diaphragm defining one portion of each of the ink chambers;

a plurality of piezoelectric actuators in confrontation with the diaphragm in a one-to-one correspondence with the ink chambers;

a drive unit that deforms the piezoelectric actuator to deform the diaphragm and change the pressure inside the ink chamber to eject ink from the ink chamber through the nozzle; and a plurality of relay members in a one-to-one correspondence with the ink chambers and the piezoelectric actuators, each relay member having a first abutment surface and a second abutment surface on opposite sides thereof, each first abutment surface abutting the diaphragm across a width that extends in the nozzle alignment direction, the width of each first abutment surface being shorter than the width of the corresponding ink chamber, each second abutment surface being coupled to the corresponding piezoelectric actuator and having a width that extends in the nozzle alignment direction, the width of each second abutment surface being equal to or shorter than the width of the corresponding piezoelectric actuator, the width of each first abutment surface being shorter than the width of each second abutment surface.

36. The ink jet printer as claimed in claim 35, wherein the first abutment surface of each relay member abuts the diaphragm at a position substantially central in the corresponding ink chamber with respect to the nozzle alignment direction.

* * * * *